US008796526B2

(12) United States Patent
Kanda

(10) Patent No.: US 8,796,526 B2
(45) Date of Patent: Aug. 5, 2014

(54) BOOKLET HANDLING APPARATUS AND BOOKLET HANDLING METHOD

(75) Inventor: Mitsuyoshi Kanda, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 583 days.

(21) Appl. No.: 12/875,782

(22) Filed: Sep. 3, 2010

(65) Prior Publication Data

US 2011/0233030 A1 Sep. 29, 2011

(30) Foreign Application Priority Data

Mar. 26, 2010 (JP) ..... P2010-073707
Mar. 26, 2010 (JP) ..... P2010-073708
Mar. 26, 2010 (JP) ..... P2010-073709

(51) Int. Cl.
*G10G 7/00* (2006.01)

(52) U.S. Cl.
USPC ..... 84/486; 84/500; 84/519

(58) Field of Classification Search
USPC ..... 84/486
See application file for complete search history.

(56) References Cited

U.S. PATENT DOCUMENTS

| | | | | |
|---|---|---|---|---|
| 4,600,828 | A * | 7/1986 | Nogami et al. | 235/379 |
| 7,714,221 | B2 | 5/2010 | Ishioka | |
| 2010/0247216 | A1 * | 9/2010 | Ishioka | 400/582 |

FOREIGN PATENT DOCUMENTS

| | | |
|---|---|---|
| EP | 2 266 804 A1 | 12/2010 |
| JP | 02-310071 | 12/1990 |
| JP | 03-284993 | 12/1991 |
| JP | 07-096690 | 4/1995 |
| JP | 11-301142 | 11/1999 |
| JP | 2000-296684 | 10/2000 |
| JP | 2001-205958 | 7/2001 |
| JP | 2003-025765 | 1/2003 |
| JP | 2005-254594 | 9/2005 |
| WO | WO 85/01478 | 4/1985 |

OTHER PUBLICATIONS

Extended Search Report issued by European Patent Office in EP Patent Application No. 10175255.8 on Jun. 29, 2012.
Japanese Office Action dated Aug. 3, 2012.

* cited by examiner

*Primary Examiner* — Christopher Uhlir
(74) *Attorney, Agent, or Firm* — Oblon, Spivak, McClelland, Maier & Neustadt, L.L.P.

(57) ABSTRACT

According to one embodiment, a booklet handling apparatus includes a take in unit to take in a booklet in a closed state, a conveying unit to convey the booklet taken in by the take in unit to a predetermined position in a first direction, a page turning unit to turn, about a stitch of the booklet, a back cover of the booklet conveyed to the predetermined position by the conveying unit, a push up unit to push up a front cover of the booklet pivoting about the stitch thereof by rotating a push up cam arranged in contact with the front cover of the booklet, a support unit to support the front cover pushed up by the push up unit, and a folding unit to fold the front cover by conveying the booklet in a second direction opposite to the first direction from the predetermined position using the conveying unit while the support unit supports the front cover.

11 Claims, 23 Drawing Sheets

BOOKLET HANDLING APPARATUS AND BOOKLET HANDLING METHOD

CROSS-REFERENCE TO RELATED APPLICATION

This application is also based upon and claims the benefit of priority from Japanese Patent Applications No. 2010-073707, filed on Mar. 26, 2010; No. 2010-073708, filed on Mar. 26, 2010; and No. 2010-073709, filed on Mar. 26, 2010; the entire contents of which are incorporated herein by reference.

FIELD

Exemplary embodiments described herein relate to a booklet handling apparatus and a booklet handling method.

BACKGROUND

In financial institutions, automatic teller machines of bills are installed, and the automatic teller machine can automatically record a booklet such as a bankbook.

A recording unit of a booklet has a page turning device for turning a page, and the page turning device turns pages to reach a page on which printing is to be performed.

A booklet is not always inserted in a normal state in which the cover of the booklet is up. A booklet may be inserted in various states, for example, in a face reversed state.

In this case, a conventional method requires the following operation, for example. (1) The booklet is once conveyed back to a booklet insert portion, and an operator is asked to insert the booklet again with the cover being up. (2) Pages of inner sheets are turned again and again to reach a page close to a predetermined cover.

However, in the method (1), it is cumbersome for the operator to do so, In the method (2), there is a problem in that a processing time becomes enormous as the number of pages of the booklet increases.

In order to solve these problems, an opened page may be once folded and closed, and a booklet reversing apparatus coupled with a turning apparatus may reverse the booklet. That is, after the cover is placed upside, the page turning apparatus may perform turning operation from the cover (or the back cover).

For example, the reversing apparatus has a booklet holding plate for holding a conveyed booklet, and this booklet holding plate is rotated 180 degrees by a rotation mechanism, so that the booklet is rotated.

In this method, however, the reversing apparatus is particularly needed to reverse the folded booklet. Therefore, there is a drawback in that the apparatus becomes large.

An apparatus has been developed in order to solve this problem. In this apparatus, the opened page and the page on the opposite side are closed together with the cover at a time. This apparatus can perform printing onto a page on the side of the cover without using the reversing apparatus.

Recently, booklets having pages of a high flexural rigidity for adding a high value have emerged. For example, such booklets have an ID page attached with a security protection layer for preventing counterfeiting and falsification of private information and a plastic page including an IC chip capable of high density recording. Some booklets have wireless IC chips capable of reading and writing information without contact. Front covers and back covers of some booklets have a radio wave insulating function in order to protect recorded information from illegal reading and writing operation. Such booklets can be read and written only when front the cover is turned over.

The above-described conventional apparatus pushes up a middle portion of a page of a booklet by using conveyor roller pairs sandwiching the middle portion. Therefore, when the booklet has a low flexural rigidity and is soft, the apparatus can bend and push up the booklet. However, when the booklet has a high flexural rigidity and is hard, the apparatus cannot push up the booklet, and there is a drawback in that, if the apparatus forcibly pushes up the booklet, the booklet may be damaged. Therefore, the conventional apparatus is far from convenient.

DETAILED DESCRIPTION

In general, according to one embodiment, there is provided a booklet handling apparatus including a take in unit to take in a booklet in a closed state, a conveying unit to convey the booklet taken in by the take in unit to a predetermined position in a first direction, a page turning unit to turn, about a stitch of the booklet, a back cover of the booklet conveyed to the predetermined position by the conveying unit, a push up unit to push up a front cover of the booklet pivoting about the stitch thereof by rotating a push up cam arranged in contact with the front cover of the booklet, a support unit to support the front cover pushed up by the push up unit, and a folding unit to fold the front cover by conveying the booklet in a second direction opposite to the first direction from the predetermined position using the conveying unit while the support unit supports the front cover.

Embodiments will be hereinafter described with reference to the drawings.

First Embodiment

An embodiment will be hereinafter described in detail with reference to the drawings.

Figure 1:
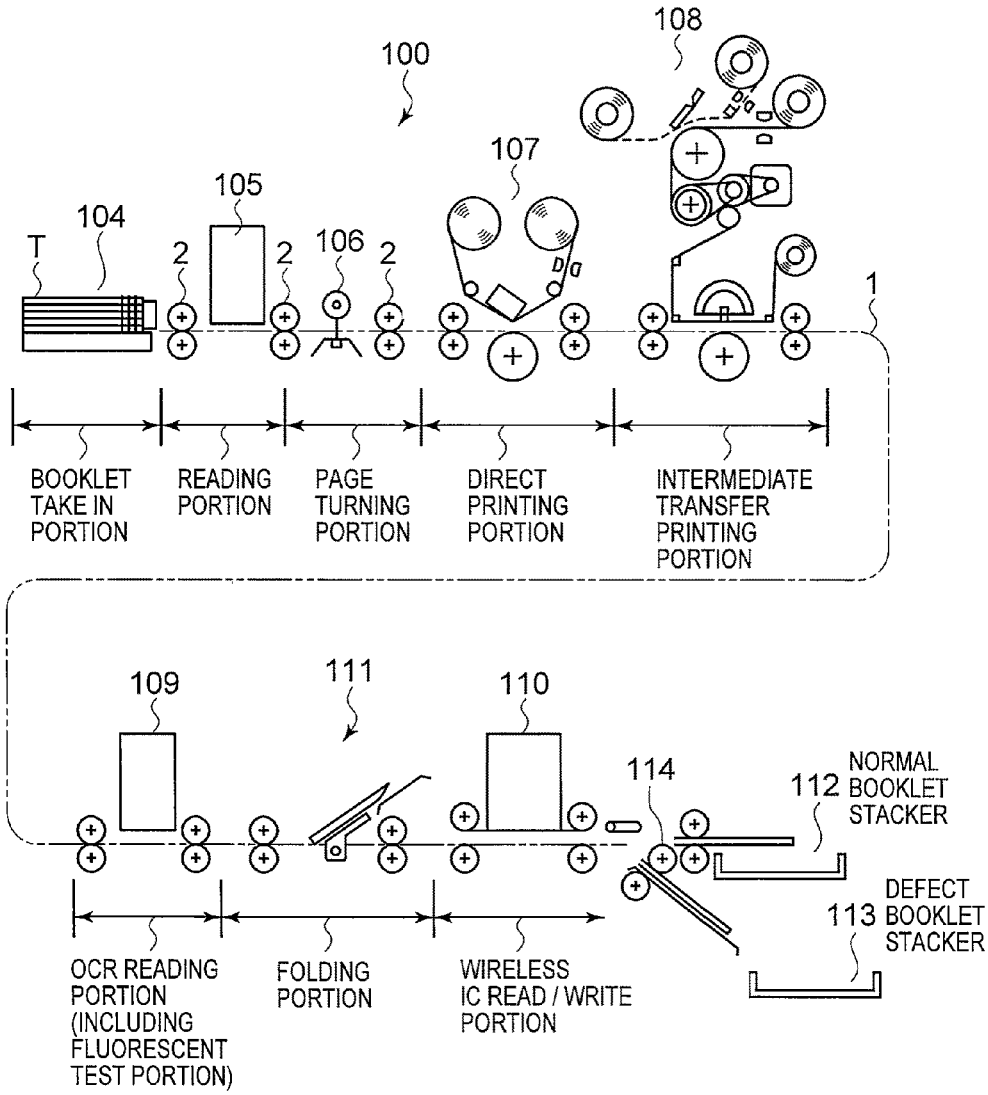
FIG. 1 is a conceptual diagram illustrating an entire booklet issuing apparatus according to a first embodiment.

FIG. 1 is a conceptual diagram illustrating an entire booklet issuing apparatus 100 according to an embodiment.

A booklet issuing apparatus 100 has a booklet take in portion 104. A plurality of booklets T are stacked and set on the booklet take in portion 104 in such a manner that the booklets T are closed, and the booklet issuing apparatus 100 takes in the booklets T one by one. The taken-in booklets T are conveyed along a conveying path 1 by a plurality of conveyor roller pairs 2. Along a conveying direction of the booklet T, the conveying path 1 is arranged with an OCR reading portion 105, a page turning portion 106, a direct printing portion 107, an intermediate transfer printing portion 108, an OCR reading portion 109, a folding portion 111, and a wireless IC read/write portion 110.

A discharge switching gate 114 is arranged at a discharge side of the conveying path 1. The discharge switching gate 114 switches the discharge direction of the booklet T between a first direction and a second direction. In the first direction, a normal booklet stacker 112 accumulating normal booklets T is arranged. In the second direction, a defect booklet stacker 113 accumulating defective booklets T is arranged.

Figure 2:
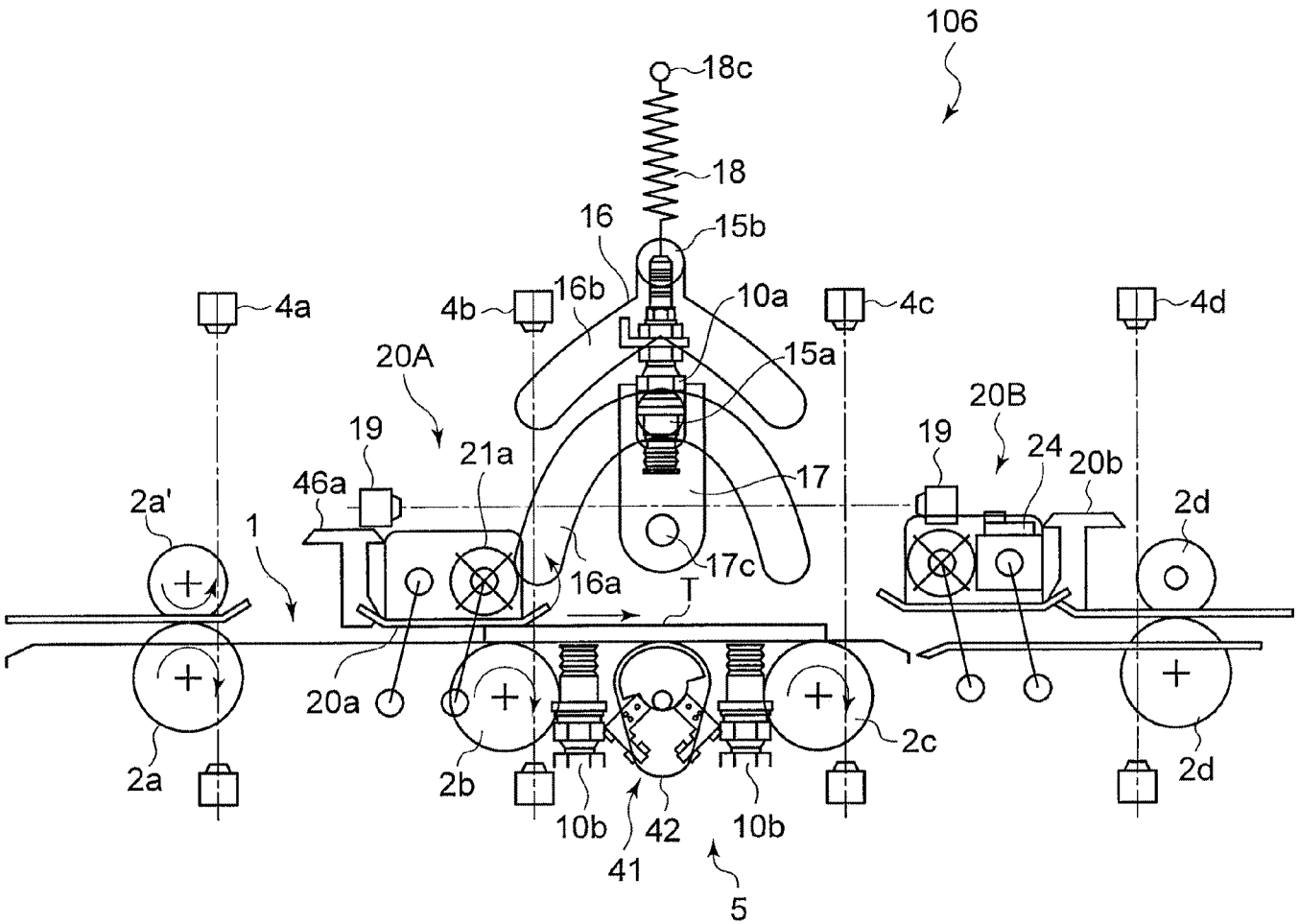
FIG. 2 is a diagram illustrating a structure of a page turning portion of a booklet according to the first embodiment.

FIG. 2 is a diagram illustrating a structure of a page turning portion 106 according to the first embodiment.

Figure 6:
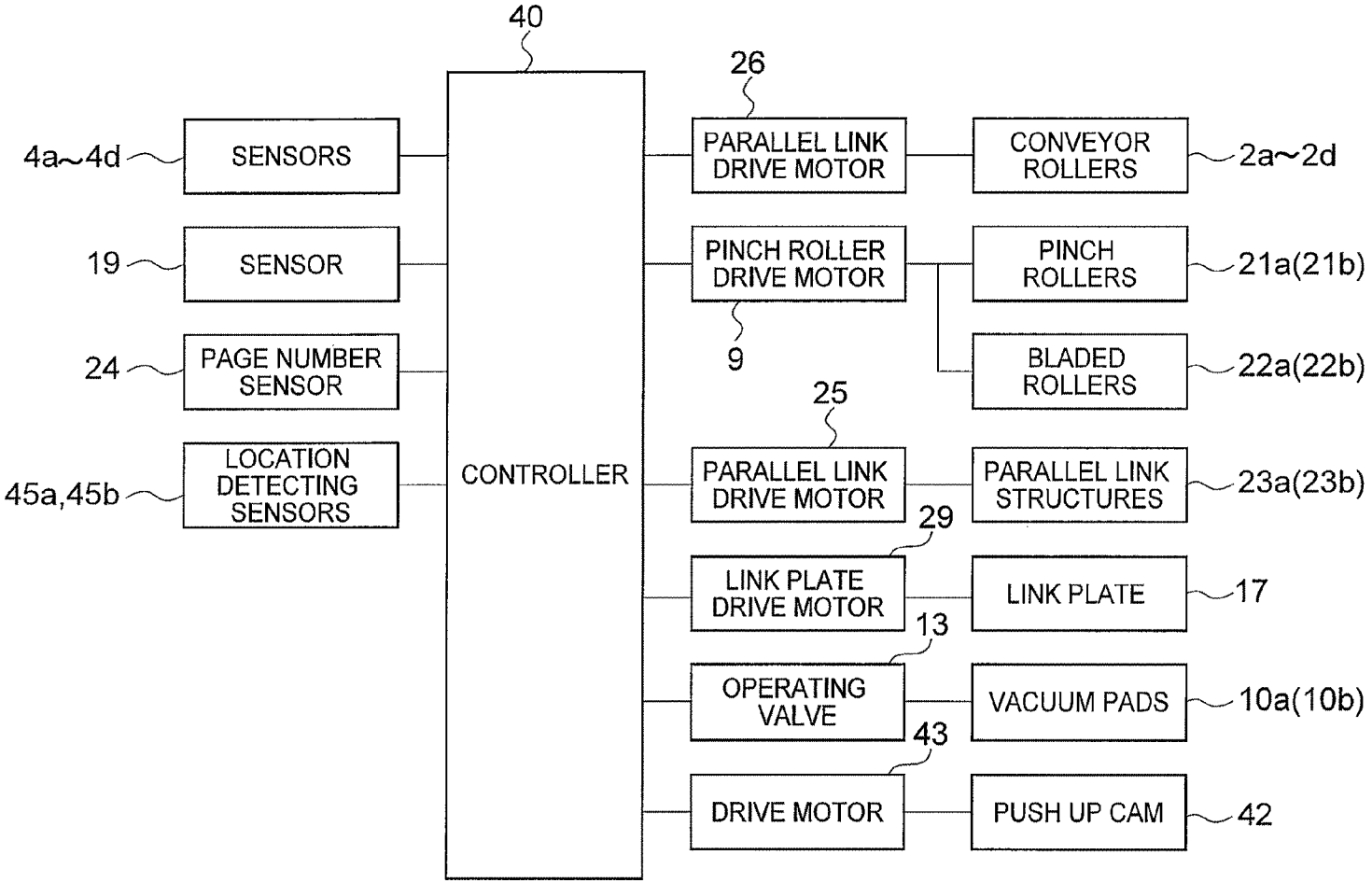
FIG. 6 is a block diagram illustrating a drive control system for the page turning portion of FIG. 2.

Along the conveying path 1, a plurality of conveyor rollers 2*a* to 2*d* (which may be collectively referred to as conveyor rollers 2 including conveyor rollers 2*a* to 2*d* arranged in the page turning portion 106) are arranged with a predetermined interval along the conveying direction of the booklets T, and sensors 4*a* to 4*d* are arranged to optically detect the booklet T. Pinch rollers 2*a*' and 2*d*' are in rolling contact with an upper surface portion of the conveyor rollers 2*a* and 2*d*, and the conveyor rollers 2*b* and 2*c* are arranged at a page flip position 5. The conveyor rollers 2*a* to 2*d* are rotated and driven by a conveyor roller drive motor 26 as shown in FIG. 6.

Conveyor structures 20A and 20B are respectively arranged at an upper portion side of the conveyor rollers 2*b* and 2*c*. At an upper portion side of the page flip position 5, a sensor 19 is arranged to optically detect a page sucked and raised by the vacuum pad 10*a*, which is described later. Further, a page number sensor 24 is arranged to detect a page number of a turned page. The sensors 4*a* to 4*d*, the sensor 19, and the page number sensor 24 are connected to a controller 40 via a signal circuit as shown in FIG. 6.

Figure 3:
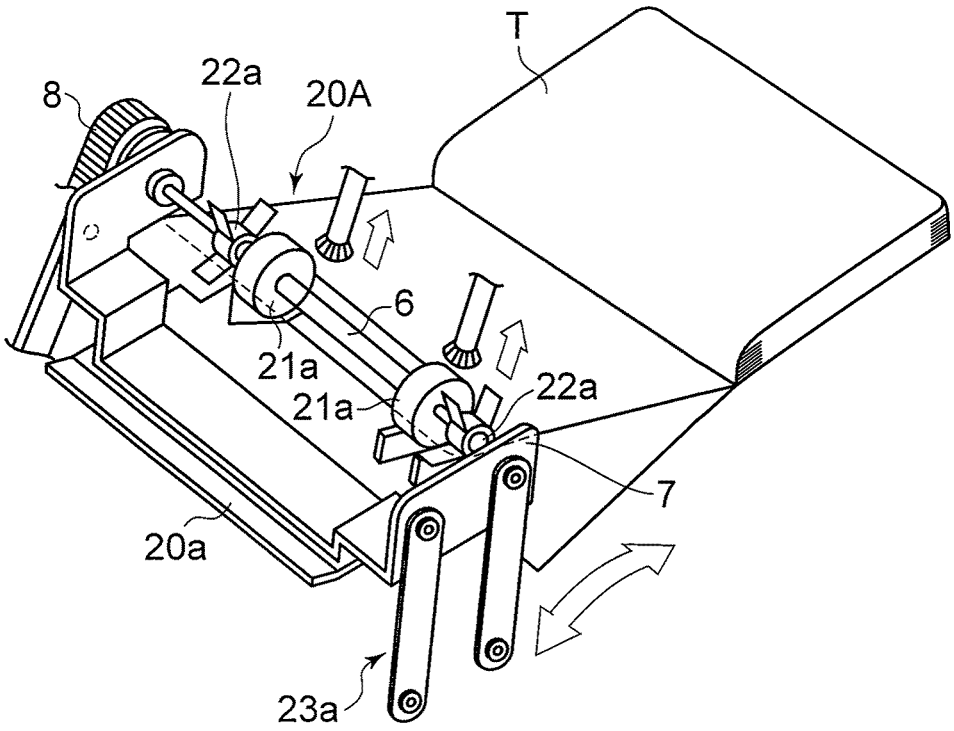
FIG. 3 is a perspective view illustrating pinch rollers, blade wheels of the page turning portion of FIG. 2, and a driving system therefor.

The conveyor structure 20A has a pinch roller 21*a*. The pinch roller 21*a* is attached to a shaft 6 as shown in FIG. 3. The shaft 6 is attached with a bladed wheel 22*a* at a position close to the pinch roller 21*a*. The bladed wheel 22*a* has a plurality of flexible striking plates on a peripheral surface portion. During rotation, the striking plates are brought into contact with the booklet T, so as to strike down pages below a desired page to be turned.

FIG. 3 illustrates pinch rollers 21*a*, blade wheels 22*a*, and a driving system therefor according to the first embodiment.

The shaft 6 is rotatably supported by the support bracket 7, and one end side of the shaft 6 protrudes outward of the support bracket 7. A protruding portion of the shaft 6 is connected to a pinch roller drive motor 9 as shown in FIG. 6 via a drive belt 8. The pinch roller 21*a* and the bladed wheel 22*a* are rotated and driven in the normal and reverse directions by the pinch roller drive motor 9.

A guide member 20*a* is integrally attached to the support bracket 7. The guide member 20*a* guides the booklet T being conveyed. The support bracket 7 is supported by a parallel link structure 23*a*. The parallel link structure 23*a* is rotated in the normal and opposite directions by a parallel link drive motor 2 as shown in FIG. 6. According to the rotation of the parallel link structure 23*a*, the guide member 20*a* as well as the pinch rollers 21*a* and the bladed wheels 22*a* move between a conveying position close to the conveyor roller 2*b* and a standby position at an obliquely upper left position of the conveying position.

The conveyor structure 20B is structured in the same manner as the conveyor structure 20A. More specifically, the conveyor structure 20B includes a guide member 20*b*, a pinch roller 21*b*, a bladed wheel 22*b*, and a parallel link structure 23*b*. The conveyor structure 20B moves the guide member 20*b*, the pinch roller 21*b*, and the bladed wheel 22*b* between a conveying position close to the conveyor roller 2*c* and a standby position at an obliquely upper left position of the conveying position.

An absorption structure 10 is arranged at the page flip position 5.

Figure 4:
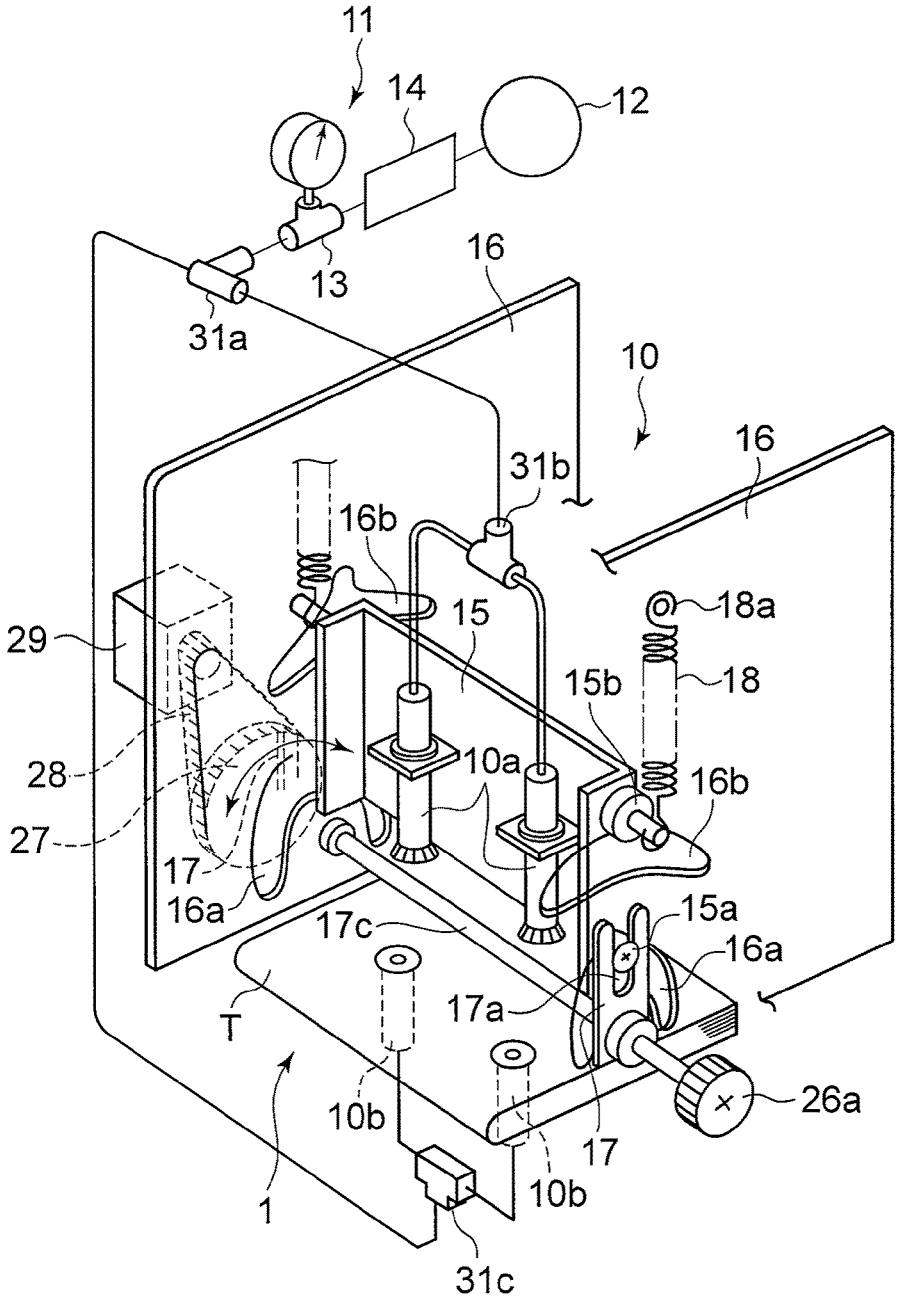
FIG. 4 is a perspective view illustrating vacuum pads of the page turning portion of FIG. 2 and a driving system therefor.

The absorption structure 10 will be hereinafter described with reference to FIG. 4.

The absorption structure 10 has upper and lower vacuum pads 10*a* and 10*b* arranged above and below the conveying path 1. The lower vacuum pad 10*b* is attached with its sucking opening facing upward, so as to face a lower surface side of the booklet T conveyed to a position immediately above the lower vacuum pad 10*b*. The upper vacuum pad 10*a* is attached to a support carriage 15. The vacuum pads 10*a* and 10*b* are connected to a pump 12 via a negative pressure supply circuit 11. The negative pressure supply circuit 11 is arranged with a filter 14 for separating dust from air sucked by a negative pressure, an operating valve 13 for switching a negative pressure, and branch pipes 31*a* to 31*c*.

When the operating valve 13 is opened, a negative pressure is generated in the vacuum pads 10*a* and 10*b*. When the vacuum pads 10*a* and 10*b* face the booklet T, the booklet T is attracted to the vacuum pads 10*a* and 10*b*. A sucking force W [N] of the vacuum pads 10*a* and 10*b* can be derived according to the following equation.

$$W=0.1\times P\times A/S$$

P: Vacuum Pressure (Gauge Pressure) [−kPa]

A: Size of Vacuum Pad [$cm^2$]

S: Safety Rate

On the other hand, the guide wheels 15*a* and 15*b* are respectively arranged at upper and lower positions of front and back surfaces of the support carriage 15. Guide plates 16 are respectively arranged in front and back directions of the support carriage 15. The guide wheels 15*a* and 15*b* of the support carriage 15 are engaged in cam grooves 16*a* and 16*b* of the guide plates 16.

The lower guide wheel 15*a* is engaged in a groove portion 17*a* of a link plate 17. The link plate 17 is connected to a drive shaft 17*c* (rotational axis), and the drive shaft 17*c* is extended between a pair of guide plates 16. One end side of the drive shaft 17*c* is attached with a hand knob 26*a*. The other end side of the drive shaft 17*c* is connected to a link plate drive motor 29 via a drive pulley 27 and a drive belt 28.

A shaft of the upper guide wheel 15*b* is connected to a hook portion 18*a* via a spring 18. The support carriage 15 is resiliently urged upward.

When the link plate drive motor 29 starts driving, the drive shaft 17*c* is rotated via the drive belt 28 and the drive pulley 27, and the link plate 17 is rotated in the normal and reverse directions (right and left directions). According to this rotation, the guide wheels 15*a* and 15*b* are guided along these two cam grooves 16*a* and 16*b* of the guide plate 16, thereby moving the support carriage 15.

In an initial state prior to moving the support carriage 15, the link plate 17 is in twelve o'clock direction, and the vacuum pad 10*a* supported by the support carriage 15 waits at an upward standby position.

Figure 5:
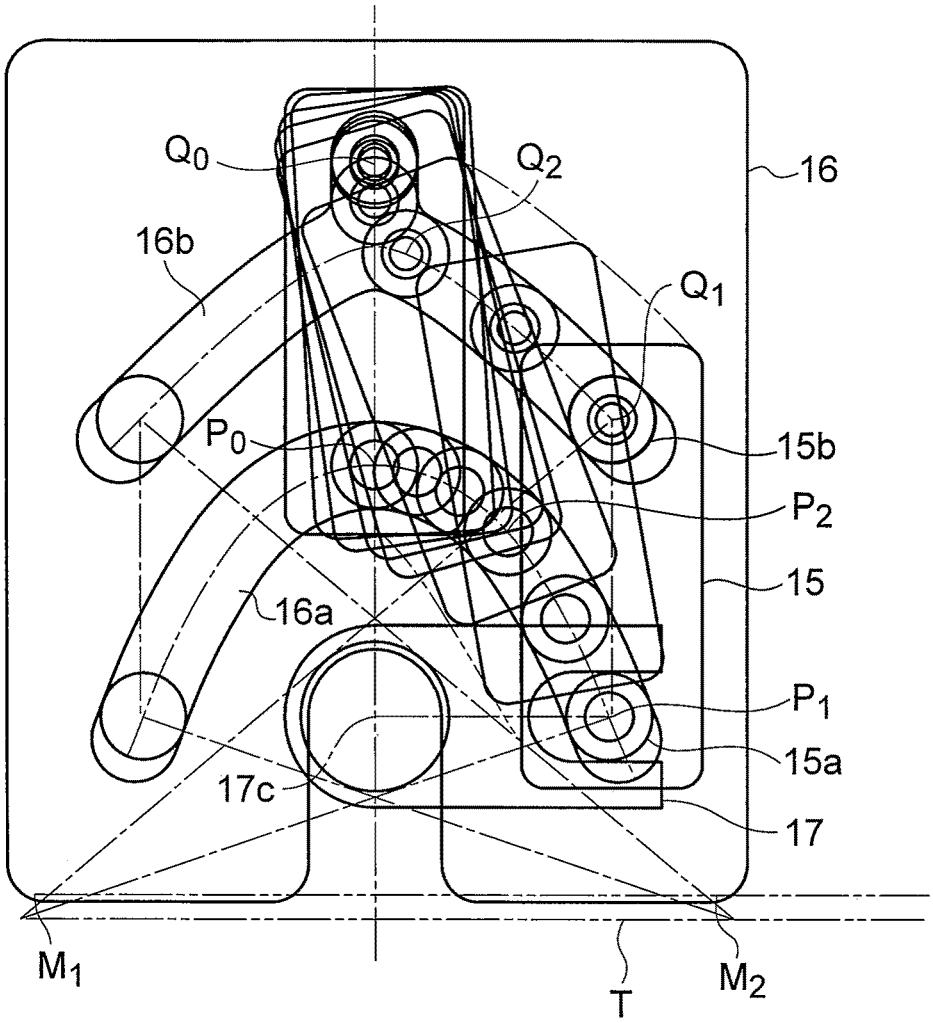
FIG. 5 is a figure illustrating locus in which the vacuum pads of FIG. 4 move.

FIG. 5 illustrates locus of the support carriage 15 of the pads moving along the cam grooves 16*a* and 16*b* of the guide plate 16 and the page flip position 5 of the booklet T according to the first embodiment.

$M_1$ denotes a stitch position of the booklet T at the page flip start position. $M_2$ denotes a stitch position of the booklet T at the reverse page flip start position. Pn denotes a center position of the guide wheel 15*a*. Qn denotes a center position of the guide wheel 15*b*.

The position and direction of the support carriage 15 are determined by two points, i.e., the center positions Pn, Qn of the guide wheels 15*a* and 15*b*. The vacuum pad 10*a* moves in synchronization with the support carriage 15. More specifically, portions $P_1$ to $P_2$ and $Q_1$ to $Q_2$ of the cam grooves 16*a* and 16*b* of the guide plate 16 are arcs about the center $M_1$. In the arcs, the vacuum pad 10*a* moves in synchronization with raising operation about the rotational center of the stitch of the uppermost page of the booklet T about $M_1$.

In the reverse page turning, the shape of the cam grooves 16*a* and 16*b* of the guide plate 16 and the movement of the vacuum pad 10*a* is symmetrical with respect to the center $M_2$.

Portions $P_0$ to $P_2$ and $P_1$ to $P_2$ are formed as arcs smoothly connecting the symmetrically extended curves. A portion $Q_0$ to $Q_2$ is formed to extend backward in a linear manner in a direction of a target axis of the cam groove 16*b* of the guide plate 16.

Accordingly, the support carriage 15 becomes less inclined. When the center positions of the guide wheels 15*a* and 15*b* reach $P_0$ and $Q_0$, the support carriage 15 returns back to a vertical position, which causes the vacuum pad 10*a* to be at the upward standby position (initial position).

The link plate 17 for moving the guide wheel 15*a* about the drive shaft (rotational center) 17*c* is in twelve o'clock direction at this moment, and can move the support carriage 15 in clockwise and counterclockwise directions. With this structure, a maximum retracted position of page turning operation of the vacuum pad 10*a* and a start position of reverse page turning operation of the vacuum pad 10*a* correspond to each other. Therefore, the page turning and reverse page turning operations can be performed in a small range.

The actual stitch position of the booklet T and the positions $M_1$ and $M_2$ may be displaced from each other according to the thickness of the booklet T, a biding method of the booklet T, an arrangement of a high rigidity page within the booklet T, or a variation of the page flip start position due to the conveying operation. In the raising operation of the uppermost page of the booklet T, the vacuum pad 10*a* does not move along an ideal locus, and is displaced from the ideal locus. However, this does not cause much problem because the raising angle is small, i.e., 45 degrees or less, and there is a play allowing movement for balancing the booklet T and the vacuum pads 10*a* and 10*b*. This play is caused by an elastic deformation of the vacuum pad 10 and an elastic deformation of the booklet T close to the stitch.

FIG. 6 is a block diagram illustrating a drive control system for the page turning portion 106 according to the first embodiment.

As described above, the sensors 4*a* to 4*d*, the sensor 19, and the page number sensor 24 are connected to the controller 40 via a signal circuit. The controller 40 is connected, via a control circuit, to the drive motors 9, 25, 26, and 29 for the pinch rollers, the parallel link, the conveyor rollers, and the link plate, and the operating valve 13. The controller 40 controls and drives, based on detection signals, the pinch roller 21*a* and 21*b*, the bladed wheel 22*a* and 22*b*, the parallel link structures 23*a* and 23*b*, the conveyor rollers 2*a* to 2*d*, the link plate 17, and the vacuum pads 10*a* and 10*b*.

Subsequently, the page turning operation of the booklet T will be described with reference to FIGS. 7 to 16.

Figure 7:
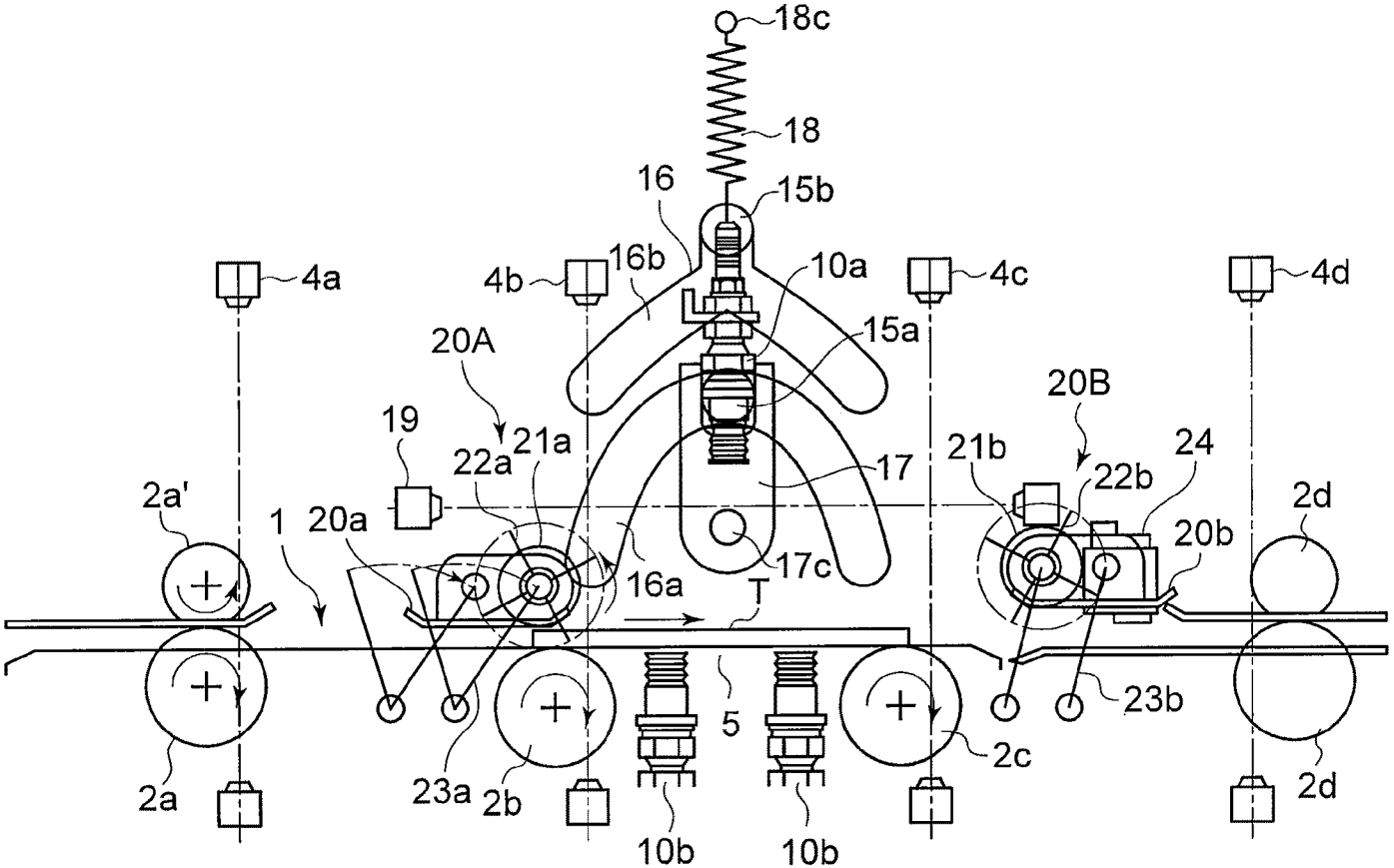
FIG. 7 is a figure illustrating a booklet conveyed to a page flip position of the page turning portion of FIG. 2.
Figure 8:
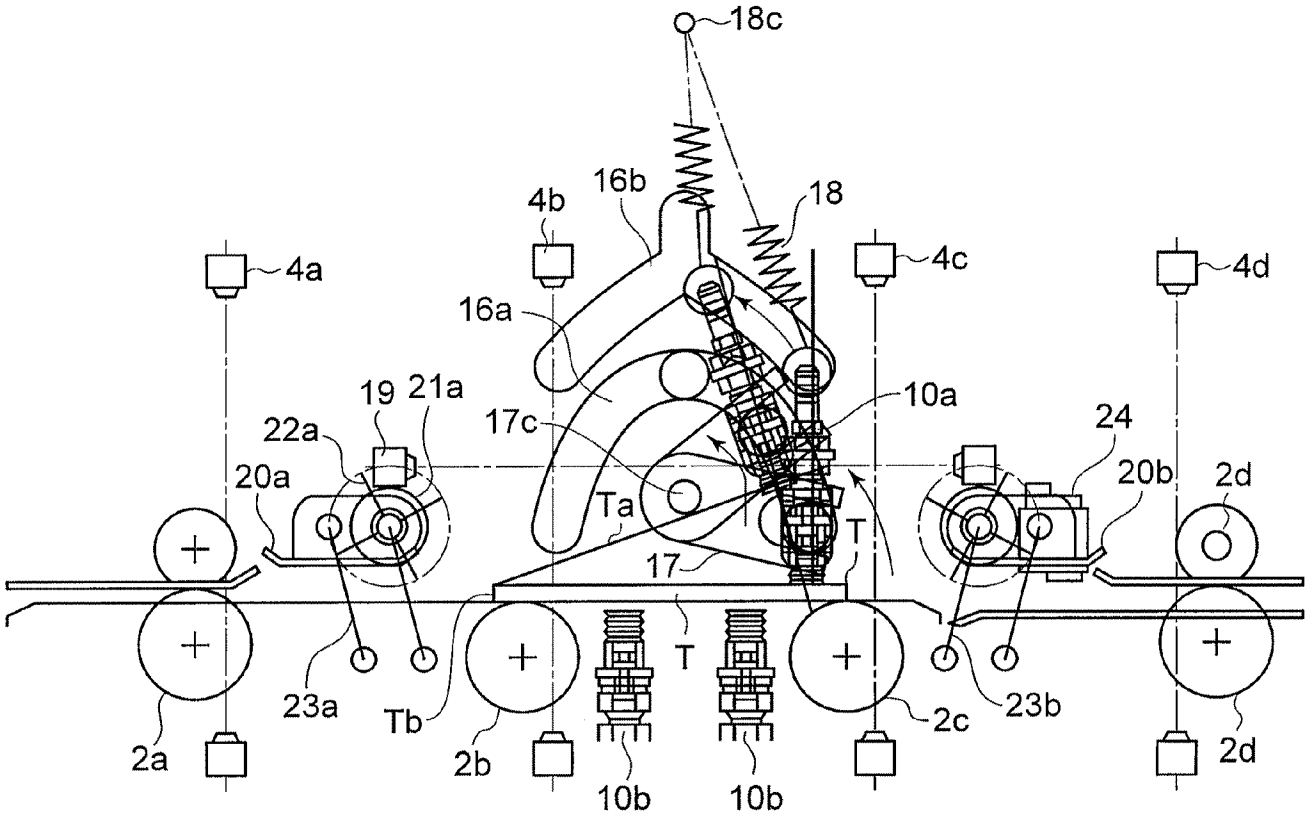
FIG. 8 is a figure illustrating a booklet conveyed to the page flip position of FIG. 7, wherein the uppermost page of the booklet is held upward by the vacuum pads.

According to the rotation of the conveyor roller 2*a* in a direction indicated by an arrow, the booklet T is conveyed along the conveying path 1 to the right in the figures. When the booklet T is conveyed to the sensor 4*b* as a result of this conveying operation, and the sensor 4*b* detects the booklet T, the controller 40 rotates the pinch rollers 21*a* and the bladed wheels 22*a* in the direction indicated by the arrow, and the controller 40 activates the parallel link structure 23*a*. As a result of this operation of the parallel link structure 23*a*, the guide member 20*a* as well as the pinch roller 21*a* and the bladed wheel 22*a* move from the standby position to the conveying position as shown in FIG. 7, and the conveying roller 2*b* and the pinch rollers 21*a* sandwich and further convey the booklet T to the right in the figures. After this conveying operation, the booklet T is detected by the sensor 4*c*. At this occasion, the conveyor roller 2*b* and the pinch roller 21*a* are rotated backward for a predetermined number of pulses, and the booklet T is conveyed backward and stops at a predetermined page flip start position 5. Subsequently, as shown in FIG. 8, the parallel link structure 23*a* is operated in the direction opposite to the booklet conveying direction, and the guide member 20*a* as well as the pinch rollers 21*a* and the bladed wheels 22*a* move from the conveying position to the standby position.

On the other hand, at this occasion, the operating valve 13 is activated, which generate a negative pressure in the vacuum pads 10*a* and 10*b*, whereby the lower side of the booklet T is sucked by the lower vacuum pad 10*b*. At this occasion, the link plate drive motor 29 is activated, which causes the link plate 17 to rotate in the clockwise direction as shown in FIG. 8. Accordingly, the upper vacuum pad 10*a* comes into contact with a front cover Ta of the booklet T and sucks the front cover Ta. Subsequently, the link plate 17 is rotated in the opposite direction (counterclockwise direction). Accordingly, while the vacuum pad 10*a* sucks the front cover Ta, and the front cover Ta moves upward along the locus of the cam groove 16*a* of the guide plate 16. Therefore, the front cover Ta of the booklet T is raised about the rotational center of the stitch Tb of the booklet T without changing the state of sucking operation of the vacuum pad 10*a*. The front cover Ta of the booklet T is simply raised about the stitch Tb of the booklet T, during which time no bending deformation force is applied to the booklet T. Therefore, the page turning operation can be performed regardless of the magnitude of the rigidity of the page.

Figure 9:
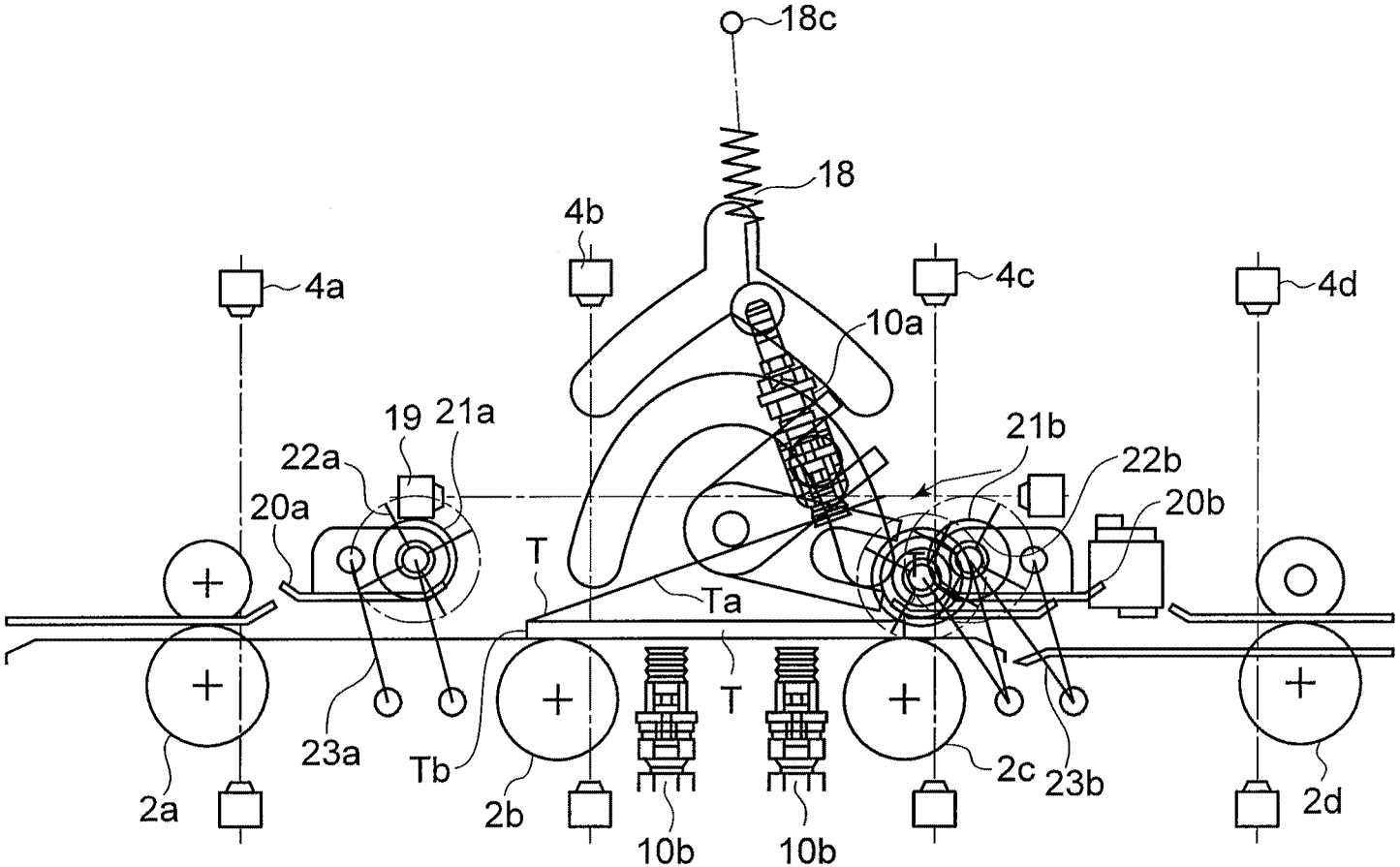
FIG. 9 is a figure illustrating a booklet, wherein the pinch rollers move into a space under the uppermost page of the booklet held upward by the vacuum pads of FIG. 8.

As described above, when the front cover Ta of the booklet T is raised to a predetermined position, the sensor 19 detects the front cover Ta. Based on this detection, the controller 40 causes the guide member 20*b* as well as the rotating pinch roller 21*b* and the rotating bladed wheel 22*b* to move from the standby position to the conveying position, as shown in FIG. 9. At this occasion, the bladed wheel 22*b* strikes down a plurality of pages having moved up together with the raised front cover Ta of the booklet T, and the pinch roller 21*b* moves onto a page immediately below the front cover Ta.

Figure 10:
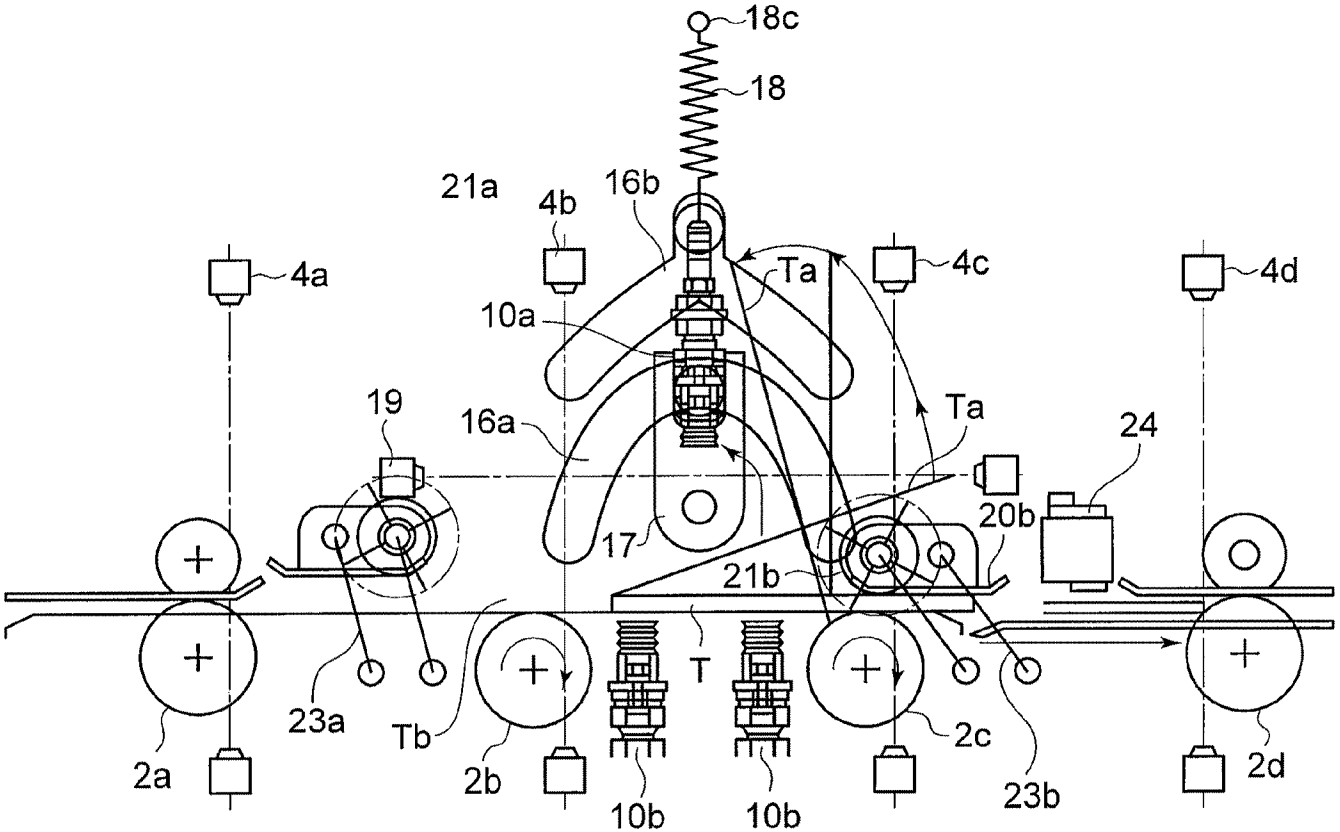
FIG. 10 is a figure illustrating the booklet which is conveyed after the pinch rollers moves into the space under the uppermost page of the booklet as shown in FIG. 9.

Subsequently, the controller 40 closes the operating valve 13, and the sucking operation of the vacuum pad 10*a* is stopped. Then, as shown in FIG. 10, the link plate 17 is returned back in the initial state, i.e., in the twelve o'clock direction, and the vacuum pad 10*a* is returned back to the upward standby position. Thereafter, according to the rotation of the conveyor roller 2*c* and the pinch roller 21*b*, the booklet T is conveyed to the right while the booklet T is sandwiched. When the sensor 4*d* detects the booklet T, the booklet T is stopped. Thereby, the front cover Ta of the booklet T is brought into contact with the pinch roller 21*b*.

Figure 11:
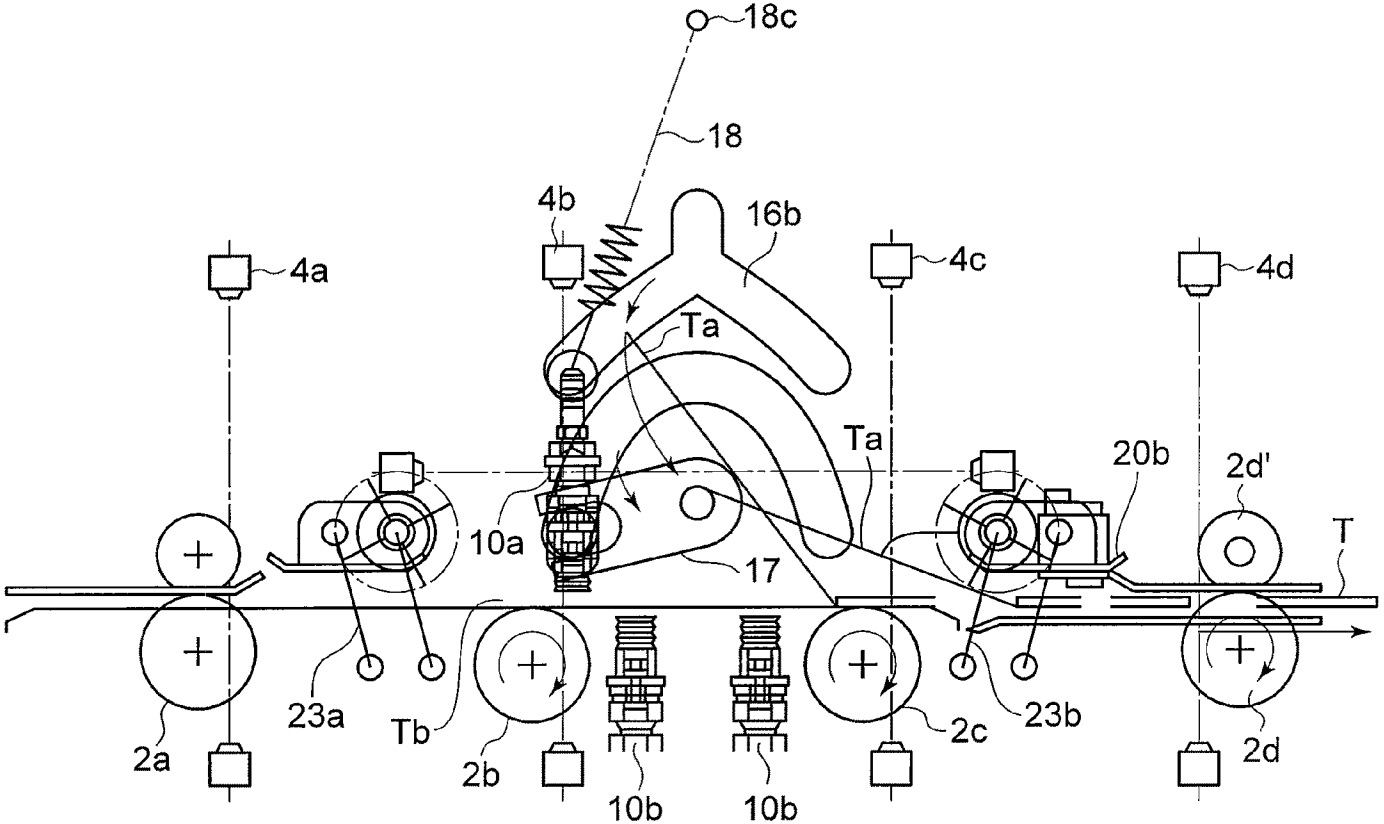
FIG. 11 is a figure illustrating the booklet, wherein the uppermost page of the booklet comes into contact with the pinch rollers and is turned over as the booklet of FIG. 10 is conveyed.
Figure 12:
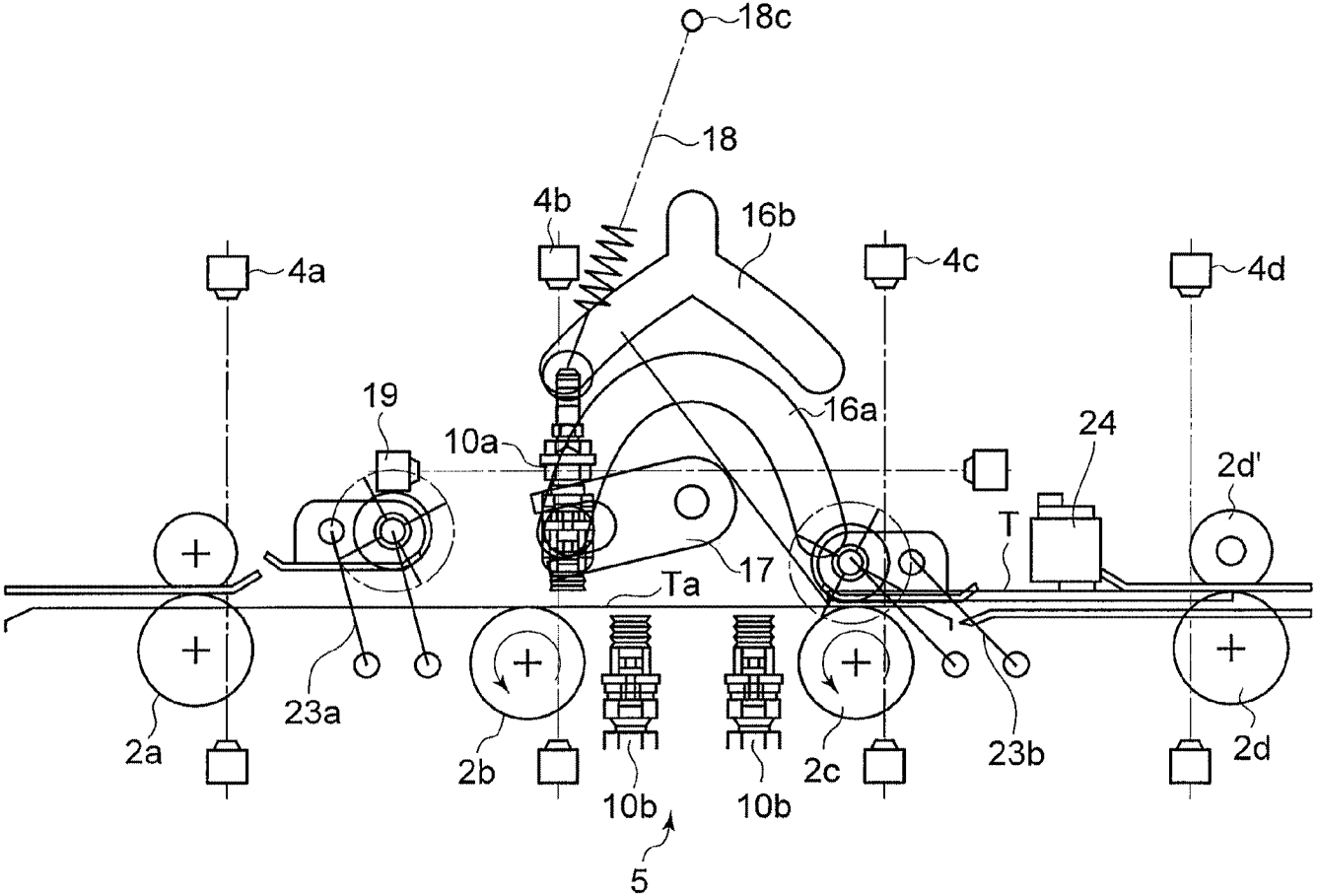
FIG. 12 is a figure illustrating the booklet, wherein the uppermost page of FIG. 11 is completely turned over.

At this occasion, the link plate 17 is rotated in the counterclockwise direction from the initial state, and the vacuum pad 10*a* is moved to retract from the turning/falling operation range of the front cover Ta of the booklet T in which pages are turned as shown in FIG. 11. In addition, at this occasion, the right end of the booklet T is already sandwiched by the conveyor roller 2*d* and the pinch roller 2*d*', and the booklet T is ready to be conveyed. Accordingly, the guide member 20*b* is brought back to standby state. In this state, the conveyor roller 2*d* is rotated, whereby the front cover Ta of the booklet T in which pages are turned is completely turned over while there is no interfering part nearby as shown in FIG. 12. Therefore, this can also complete the page turning operation without relying on the rigidity of pages in the same manner as the above.

It should be noted during this conveying operation, the page number sensor 24 scans a page number recorded on the opened front cover Ta of the booklet T. This scan information is transmitted to the controller 40, and the controller 40 determines whether operation is performed according to a program, based on the received scan information. When the controller 40 determines that the operation is not performed according to the program, the controller 40 performs the turning operation again.

Figure 13:
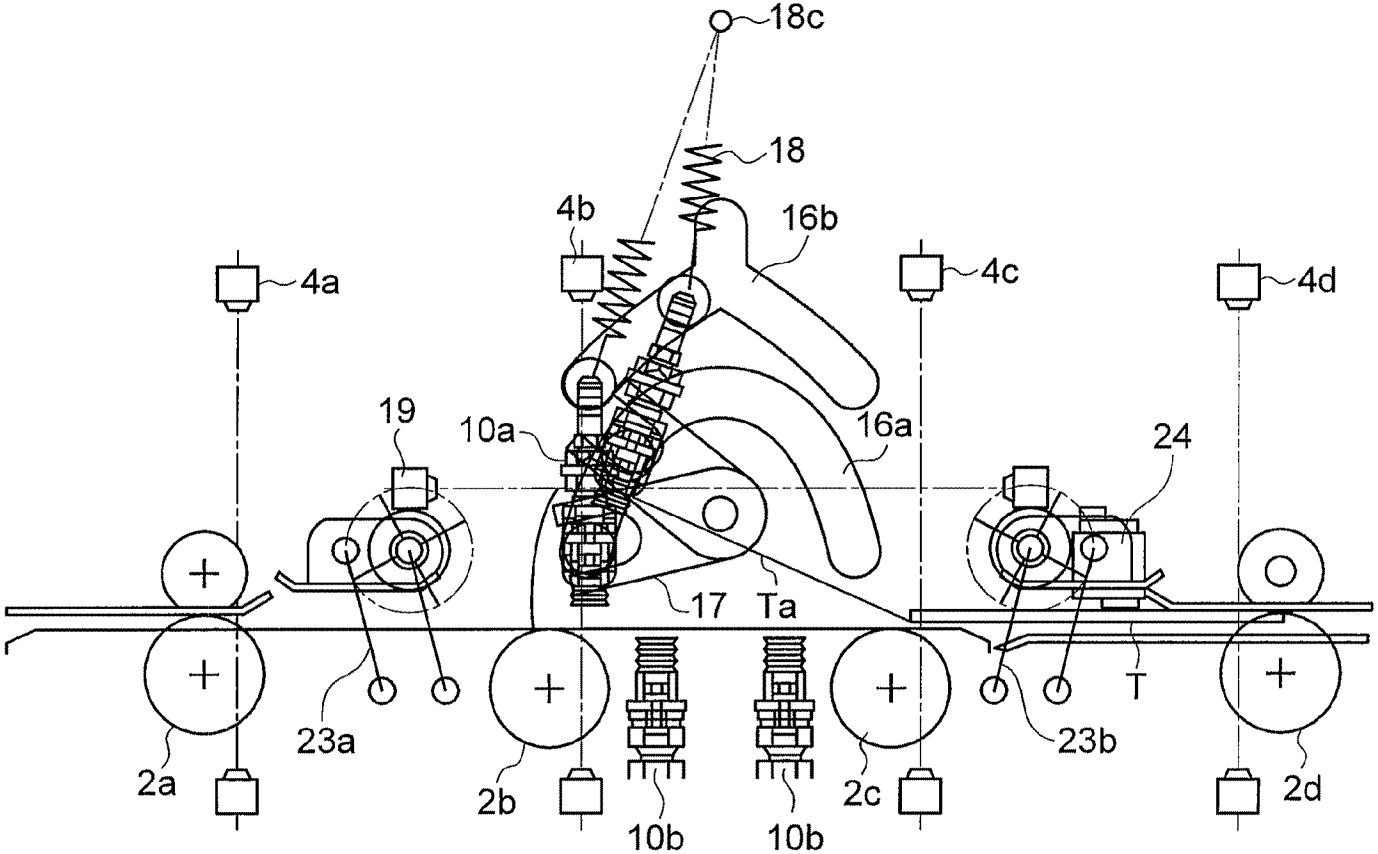
FIG. 13 is a figure illustrating the booklet, wherein the uppermost page completely turned over in FIG. 12 is pushed upward by a vacuum pad in a reverse turning direction.
Figure 14:
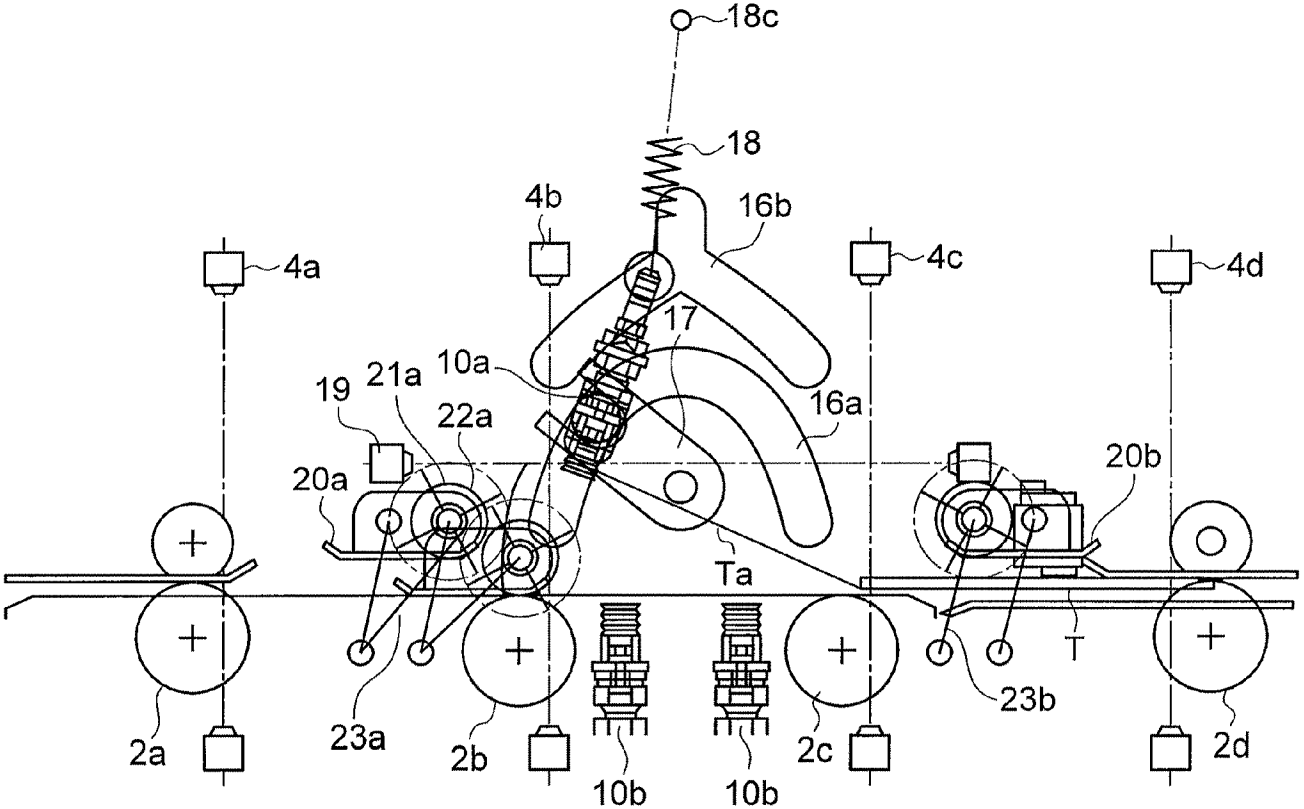
FIG. 14 is a figure illustrating the booklet, wherein pinch rollers move into a space under the uppermost page raised in FIG. 13.

When the controller 40 determines that the operation is performed according to the program, the booklet T is subjected to postprocessing. After this processing, the booklet T is moved backward to be sent to the page flip position 5 again as shown in FIG. 12. As shown in FIG. 13, the front cover Ta of the booklet T in this state is sucked and raised by the vacuum pad 10*a*. When the raised front cover Ta is detected by the sensor 19, the guide member 20*a* as well as the pinch roller 21*a* and the bladed wheel 22*a* move to the right and move into a space below the front cover Ta as shown in FIG. 14.

Figure 15:
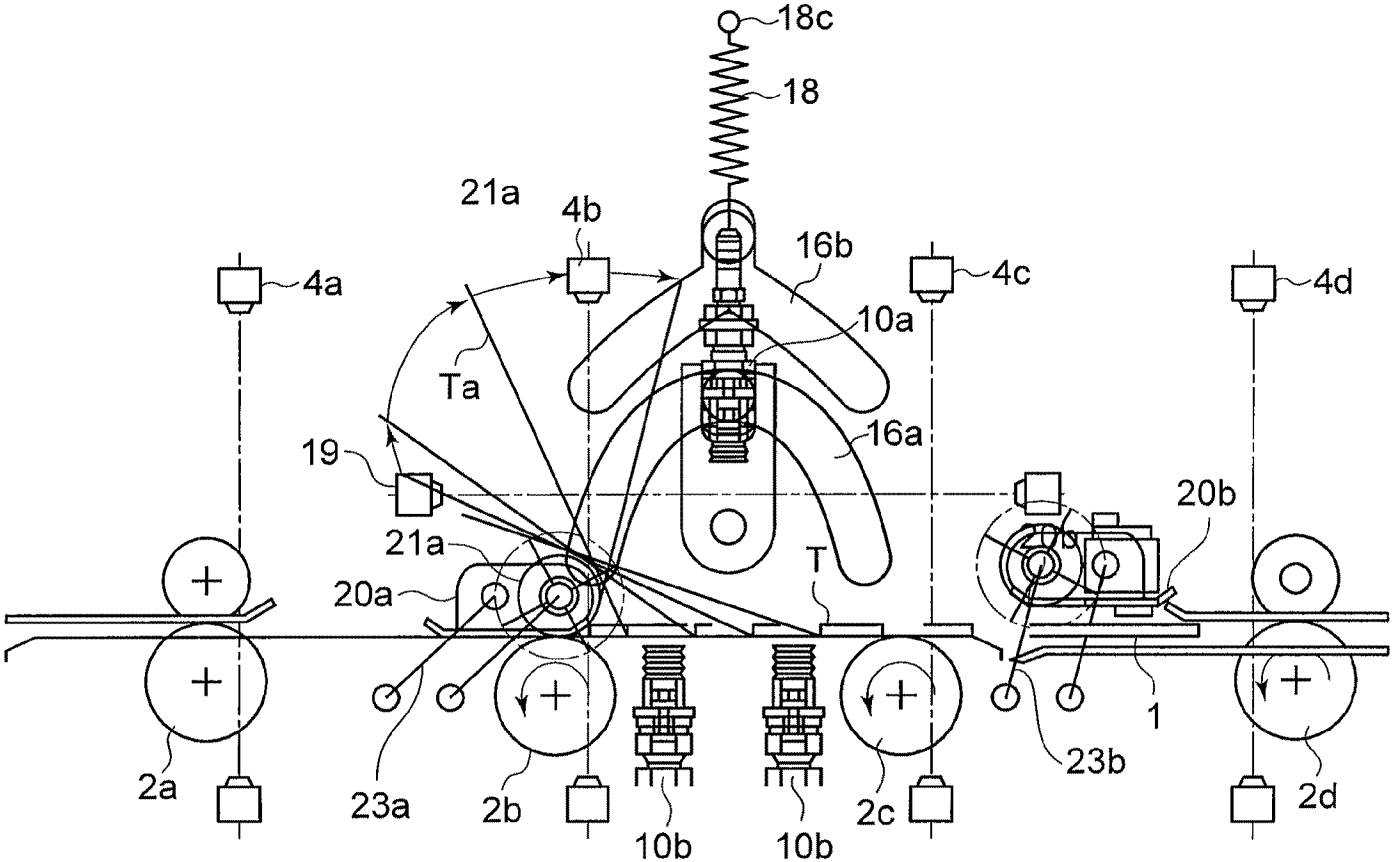
FIG. 15 is a figure illustrating the booklet, wherein the uppermost page is into contact with the pinch rollers having moved under the uppermost page in FIG. 14.
Figure 16:
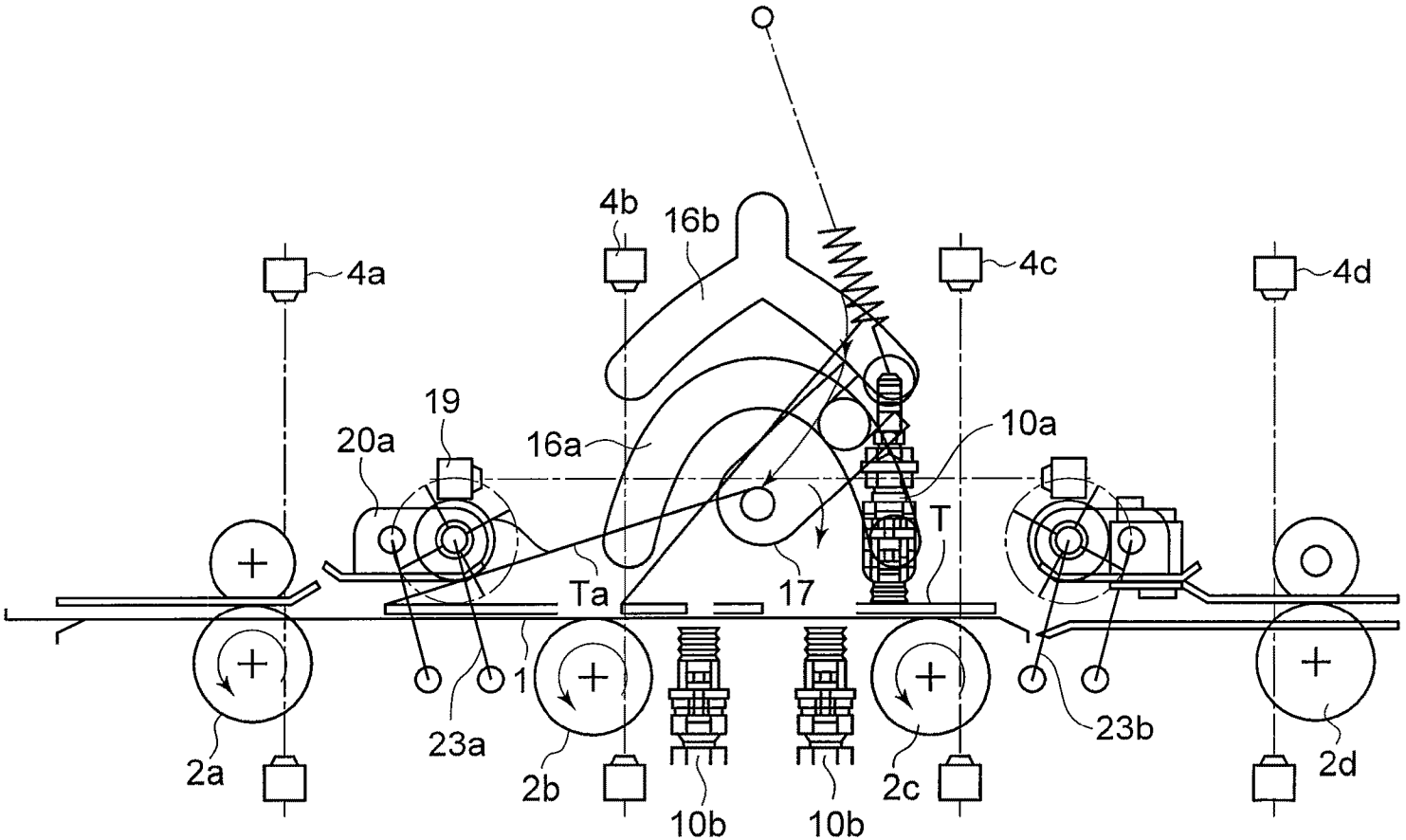
FIG. 16 is a figure illustrating the booklet, wherein the uppermost page having come in contact with the pinch rollers in FIG. 15 is largely rotated in the reverse turning direction.

Thereafter, as shown in FIG. 15, the conveyor rollers 2*b*, 2*c*, and 2*d* respectively rotate in directions indicated by arrows. Accordingly, the booklet T is conveyed to the left in the figure, and the front cover Ta comes into contact with the pinch roller 21*a* and rotates in a direction for closing the booklet T. Further, the booklet T is conveyed to the left as shown in FIG. 16, and the front cover Ta is rotated in a direction for closing the booklet T. Thereby, the booklet T is closed, and the page turning operation is terminated. During this page closing operation, the vacuum pad 10*a* is retracted from the standby position to lower right so as not to come into contact with the front cover Ta that rotates much in the closing direction.

Figure 17:
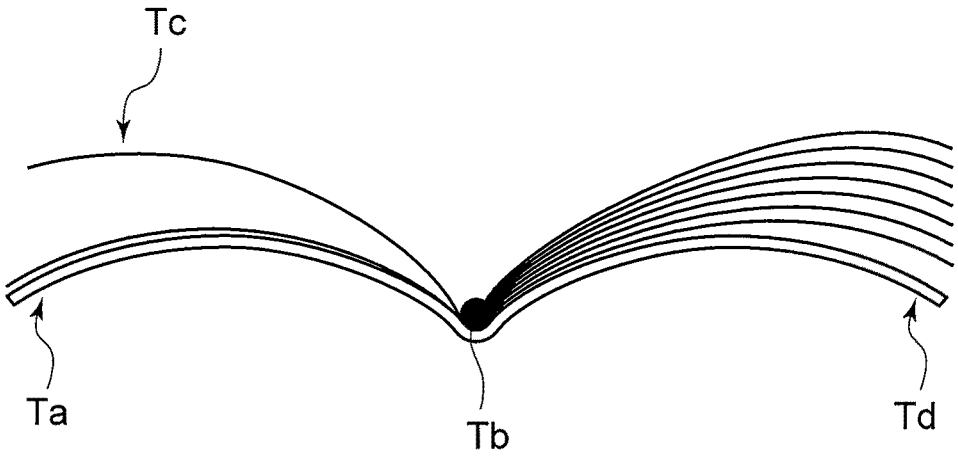
FIG. 17 is a figure illustrating a booklet whose pages are turned by the page turning portion of FIG. 2.

For example, as shown in FIG. 17, the booklet T includes the front cover Ta, inner sheets TC, and a back cover Td, and is opened/closed pivoting about the stitch Tb. A barcode is recorded on the back cover Td.

As shown in FIG. 2, the above-described page turning portion 106 is arranged with a push up mechanism 41. The push up mechanism 41 pushes up one side of the opened booklet T above the pinch roller 21*a* so as to fold the booklet T, as described later. Therefore, for example, even when the booklet T is inserted in a face-reversed state and conveyed to the page flip position 5 as shown in FIG. 19, the face of the booklet T can be reversed without using any special reversing mechanism, and pages can be turned from the front cover side of the booklet T.

As shown in FIG. 20, the push up mechanism 41 has a push up cam 42, and a base end side of the push up cam 42 is coupled, via a drive shaft 43*a*, with a drive motor 43 (see FIG. 6), i.e., pulse motor. The surface of the push up cam 42 is made of a material for reducing a contact resistance with a small friction such as a metal and a resin, so as not to damage the pages of the booklet T.

The push up cam 42 is rotated by the drive motor 43 by way of the drive shaft 43*a*, and can push upward the booklet T that is in contact with the push up cam 42 at the standby position.

The initial position of the push up cam 42 is detected by location detection sensors 45*a* and 45*b* as shown in FIG. 20. As shown in FIG. 6, the location detection sensors 45*a* and 45*b* are connected to the controller 40. The amount of rotation of the push up cam 42 can be changed by a pulse control of the drive motor 43.

The conveyor structure 20A is arranged with a guide plate 46*a* serving as a guide portion for receiving pages of the front cover side of the booklet T pushed up by the push up cam 42 as described later. The guide plate 46*a* is formed with a metal and a resin material so as not to damage pages of the booklet T.

Figure 18A:
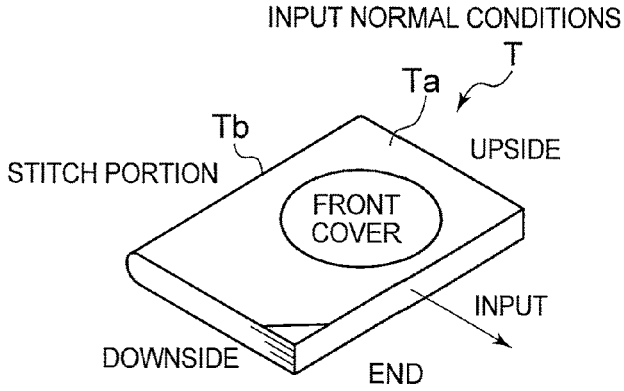
FIGS. 18A to 18D are figures illustrating page turning operation of a book inserted in a normal state.
Figure 19A:
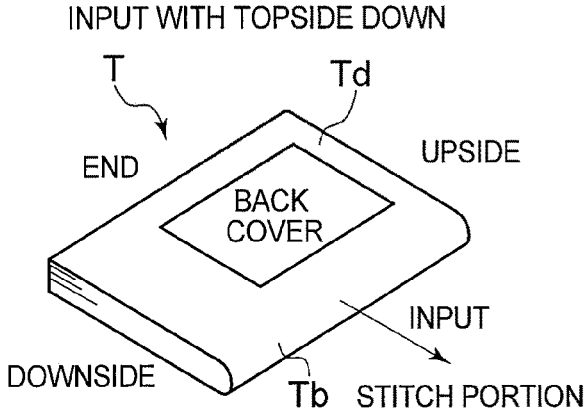
FIGS. 19A to 19E are figures illustrating turning operation of back/front covers of a booklet inserted in face-reversed state.

The booklet T is inserted in various states, and is conveyed to the page flip position 5. For example, as shown in FIG. 18A, the booklet T may be inserted with the stitch Tb being at the left side and the front cover Ta being on the upper surface side (normal insertion). Alternatively, as shown in FIG. 19A, the booklet T may be inserted with the stitch Tb being at the right side and the back cover Td being on the upper surface side (face-reversed insertion). It is necessary for the page flip position 5 to perform page turning operation according to the insertion state of the booklet T.

Figure 18B:
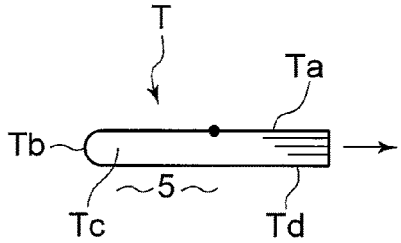
Figure 18C:
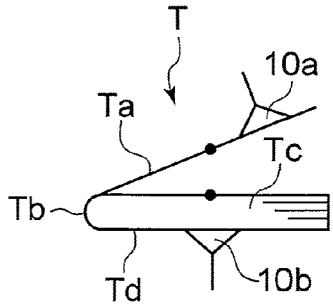
Figure 18D:
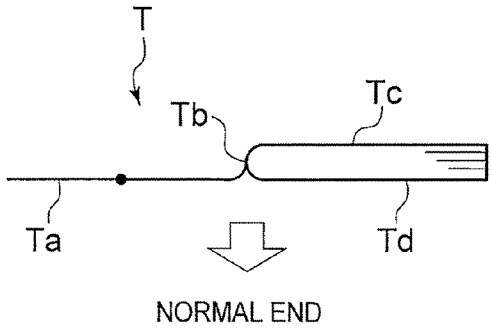

FIGS. 18A to 18D illustrate processing in a case where the booklet T is inserted in a normal state. When the booklet T is inserted as shown in FIG. 18A, and reaches the page flip position 5 as shown in FIG. 18B, left turning operation is performed by the vacuum pad 10*a* at the page flip position 5 as shown in FIG. 18C, whereby the front cover Ta is opened as shown in FIG. 18D. Thereafter, a print surface Tc (predetermined page) is likewise opened and printed, and then, the booklet T is discharged.

Figure 21A:
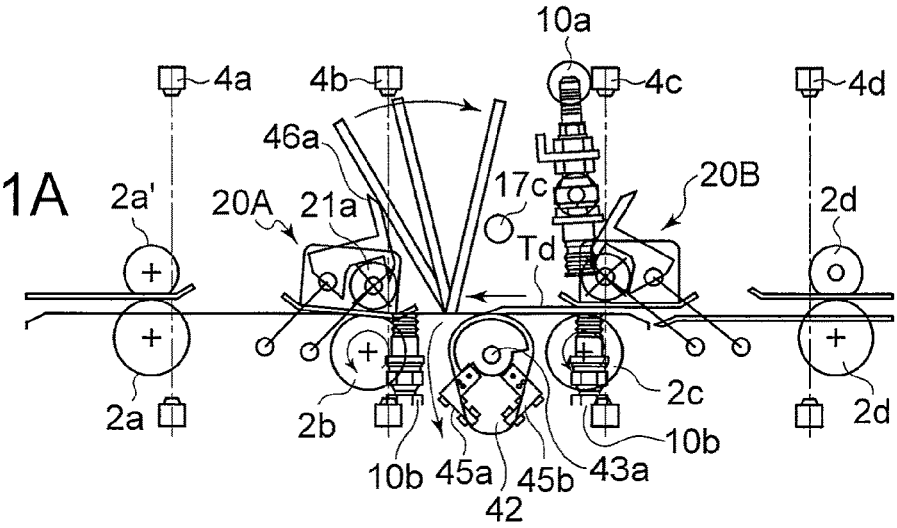
FIGS. 21A to 21C are figures illustrating push up operation for collectively pushing up pages on the front cover side of a booklet whose front/back sheets are turned in FIGS. 19A to 19E.
Figure 22:
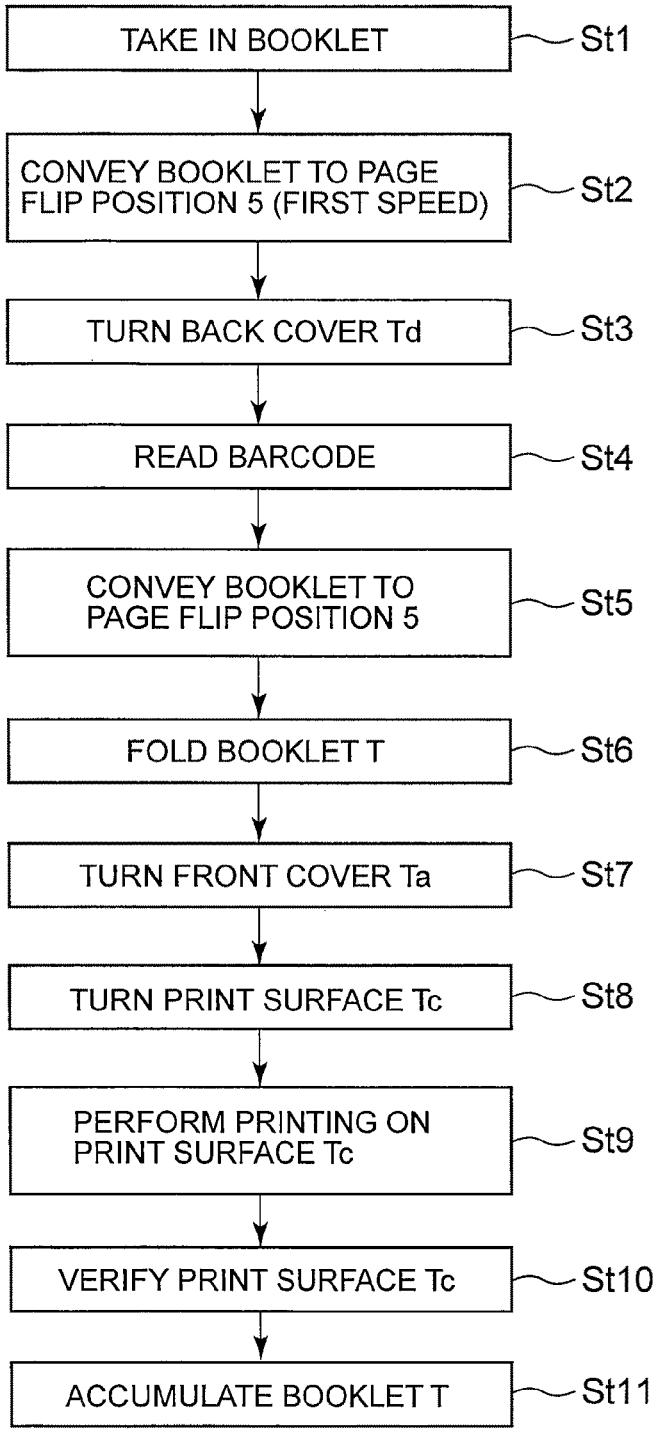
FIG. 22 is a flowchart illustrating processing operation of a booklet inserted in a face-reversed state.
Figure 23:
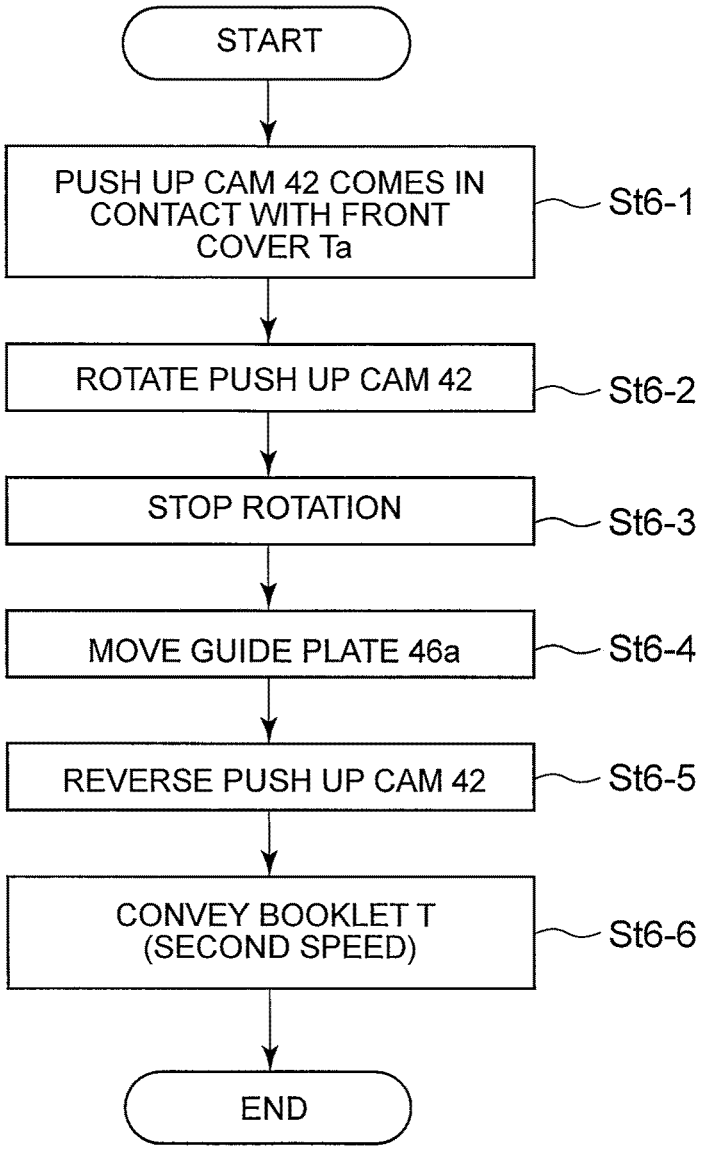
FIG. 23 is a flowchart illustrating a step St6 shown in FIG. 22 in detail.

FIGS. 19 to 21 illustrate pieces of processing in a case where the booklet T is inserted in a face-reversed state. FIG. 22 and FIG. 23 are flowcharts thereof.

The pieces of processing for the booklet T inserted in a face-reversed state will be hereinafter described with reference to FIG. 22.

A plurality of booklets T is stacked and set on the booklet take in portion 104 as shown in FIG. 1 in such a manner that the booklets T are closed as shown in FIG. 19A, and the booklets T are taken in one by one (take in unit) (St1).

Figure 19B:
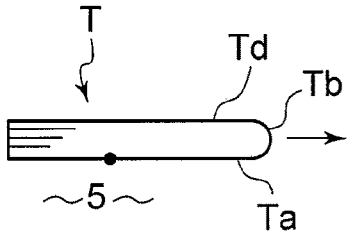
Figure 19C:
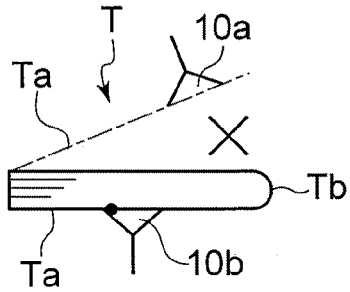

The booklet T taken-in in St1 is conveyed by a plurality of conveyor rollers 2 along the conveying path 3 to the page flip position 5 in a first speed [conveying unit] (St2). When the booklet T reaches the page flip position 5 as shown in FIG. 19B, the vacuum pad 10*a* performs left turning operation as shown in FIG. 19C in the same manner as the normal insertion state. However, the vacuum pad 10*a* sucks and tries to raise the side of the stitch Tb. Therefore, the upper vacuum pad 10*a* and the lower vacuum pad 10*b* pull each other. In this case, the plurality of vacuum pads 10*a* and 10*b* satisfies the following relationship.

$$\Sigma spfp < \Sigma SqFq$$

s and S: distance between each vacuum pad and a rotational support point during raising operation f and F: sucking force of vacuum pad A lowercase letter denotes an upper absorption vacuum pad. An uppercase letter denotes a lower absorption vacuum pad. There are upper vacuum pads 1 to p, and lower vacuum pads 1 to q.

In this relationship, as a result of the pulling between the upper vacuum pad 10*a* and the lower vacuum pad 10*b*, the upper vacuum pad 10*a* is always released from the booklet T.

Figure 19D:
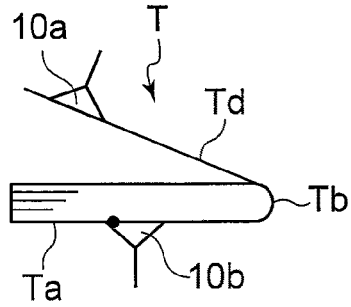
Figure 19E:
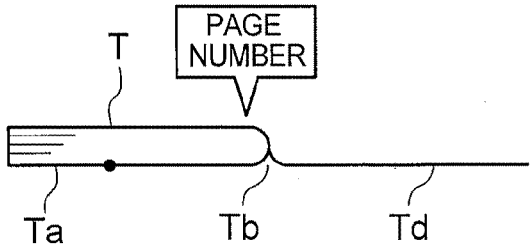

In this case, the controller 40 determines that the stitch Tb of the inserted booklet T is on the right side. Accordingly, right turning operation is performed as shown in FIG. 19D to turn the back cover Td (one surface side) as shown in FIG. 19E (page turning unit) (St3). Subsequently, the booklet T is conveyed to the OCR reading portion 105 (as shown in FIG. 1), and a barcode recorded on the back cover Td is read (St4).

Figure 20A:
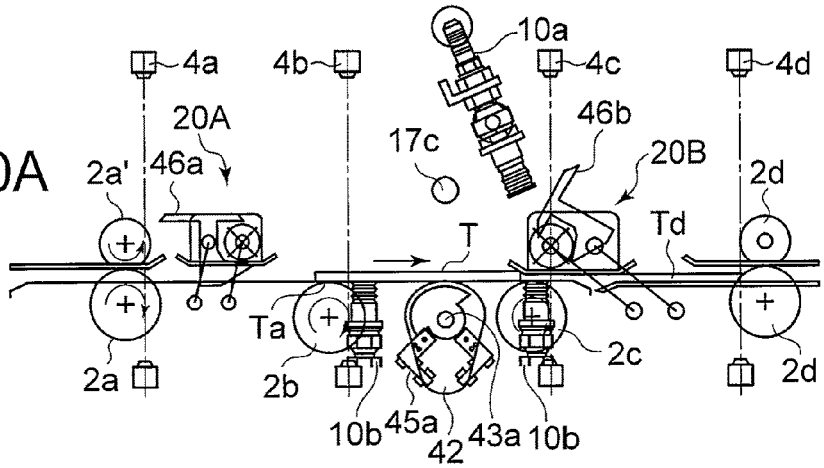
FIGS. 20A to 20C are figures illustrating push up operation for collectively pushing up pages on the front cover side of a booklet whose front/back covers are turned in FIGS. 19A to 19E.

After the barcode is read in St4, the booklet T is conveyed such that pages on the side of the front cover Ta are located at the page flip position 5 as shown in FIG. 20A (St5), and the front cover Ta is brought into contact with the push up cam 42 (push up unit) (St6-1) (FIG. 23).

Figure 20B:
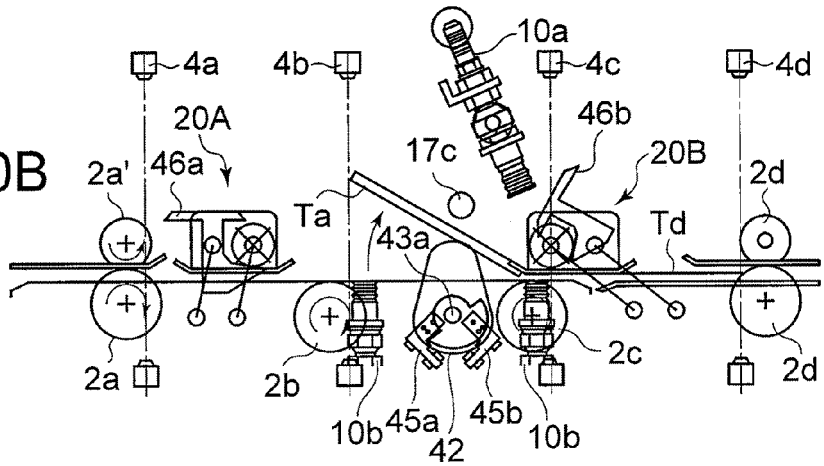

After the push up cam 42 is brought into contact with the front cover Ta, the drive motor 43 is driven in an arrow direction (shown in FIG. 20B), and the push up cam 42 is rotated (St6-2). As shown in FIG. 20B, the other end of the stitch Tb of the front cover Ta is rotated upward, whereby the side of the front cover Ta of the booklet T is pushed up. This rotation of the push up cam 42 is detected by the location detection sensors 45*a* and 45*b*, and is stopped at a predetermined height (St6-3).

Figure 20C:
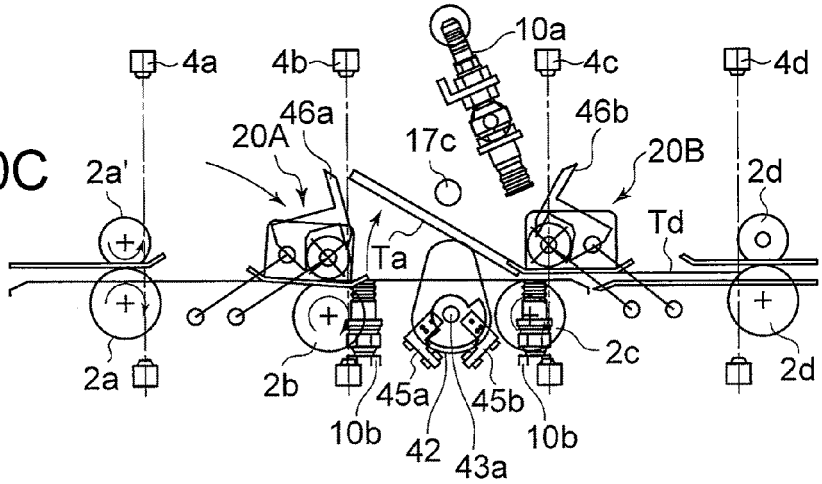

At this moment, the guide plate 46*a* (first support unit) moves into a space below pages on the side of the front cover Ta of the booklet T (St6-4). The guide plate 46*a* having moved as shown in FIG. 20C supports (from one side) and holds the page on the side of the front cover Ta of the booklet T. Thereafter, as shown in FIG. 21A, the push up cam 42 is reversed in a direction indicated by an arrow (shown in FIG. 21A) (St6-5), the conveyor rollers 2*c* and 2*d* convey the booklet T in a second speed in a direction indicated by an arrow (to the left in the figure) (St6-6). The vacuum pad 10*a* is retracted to a position shown in FIG. 21A when the sensor 4*d* detects the booklet T. After this conveying operation, the pages on the side of the front cover Ta of the booklet T are collectively pushed upward about the stitch Tb.

Figure 21B:
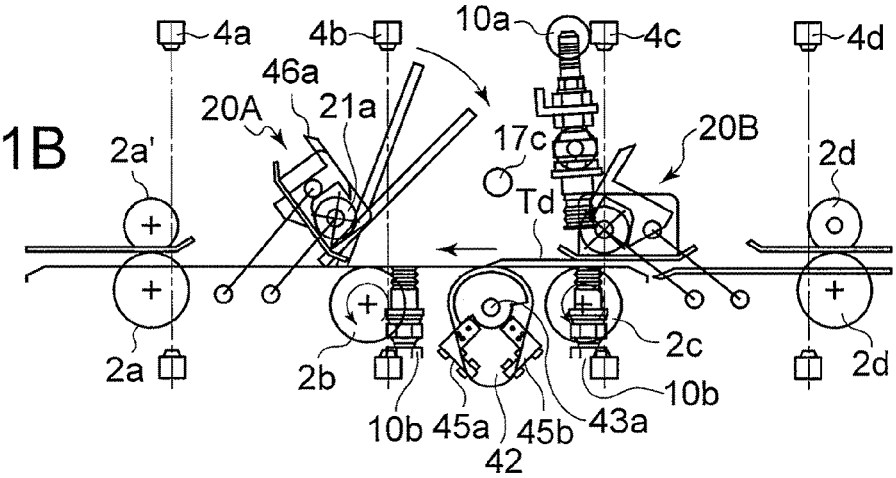
Figure 21C:
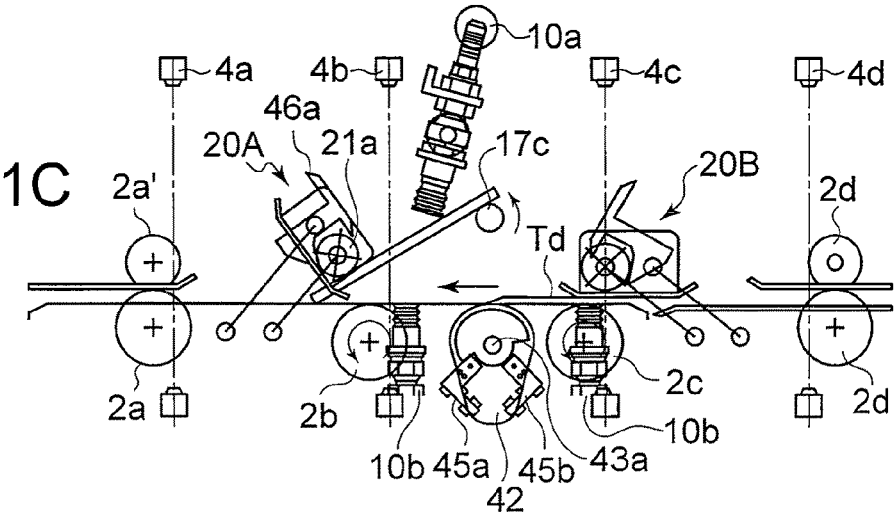

Thereafter, the booklet T is further conveyed in a direction indicated by an arrow (to the left in the figure) as shown in FIG. 21B. When the sensor 4*b* detects the booklet T, the pinch roller 21*a* moves to the standby position, and the booklet T is moved between the conveyor roller 2*b* and the pinch roller 21*a*. Then, the pages on the side of the front cover Ta are folded (St6). Further, when the pages are folded, the pages on the side of the front cover Ta are supported (from the other side) by the drive shaft 17*c* (second support unit) as shown in FIG. 21C. This supporting drive shaft 17*c* is rotated and controlled in a direction indicated by an arrow in FIG. 21C, and as shown in FIG. 21C, the vacuum pad 10*a* presses down the pages on the side of the front cover Ta so as to urge the pages on the side of the front cover Ta and further fold the pages.

Accordingly, the surface of the drive shaft 17C is made of a material having a large friction such as rubber so as to increase contact resistance between the surface of the drive shaft 17C and the booklet T. An end portion of the vacuum pad 10*a*, i.e., a contacting portion between the vacuum pad 10*a* and a page, is made of a material for reducing a contact resistance with a small friction such as a metal and a resin, so as not to damage the pages of the booklet T.

As described above, the drive shaft 17*c* constitutes a part of the drive mechanism of the page turning unit. Since the pages on the side of the front cover Ta are urged using the drive shaft 17*c* serving as the part of the drive mechanism of the page turning unit, folding operation can be enhanced without separately arranging an urging mechanism. Likewise, the vacuum pad 10*a* constitutes a part of the absorption structure 10 as described above. Since the pages on the side of the front cover Ta are pushed down using the vacuum pad 10*a* serving as the part of the absorption structure 10, folding operation can be enhanced without separately arranging an urging mechanism.

The booklet T folded in St6 is now in the same state as the normal insertion state as shown in FIG. 18A described above. As shown in FIG. 18B, the booklet T is conveyed to the page flip position 5. As shown in FIG. 18C, the vacuum pad 10*a* performs left turning operation at the page flip position 5. As shown in FIG. 18D, the front cover Ta is turned (St7). Thereafter, the print surface Tc is turned (St8), and a direct printing portion (or intermediate transfer printing portion 108) as shown in FIG. 1 performs print processing to print data onto the print surface Tc (print unit) (St9).

The OCR reading portion 109 reads the print surface Tc subjected to the print processing in St9, and verifies whether the printing operation is performed normally (St10). The booklet T determined to be normally printed as a result of the verification in St10 is conveyed to and accumulated on a normal booklet stacker 112. On the other hand, the booklet T determined to be abnormally printed as a result of the verification in St10 is conveyed to an abnormal booklet stacker 113, and folded by a folding portion 111. Thereafter, the booklet T is accumulated (accumulation unit) St11).

As described above, in this embodiment, the booklet T is processed as follows. In a case where the booklet T is inserted in a face-reversed state, and is conveyed to the page flip position 5, the back cover Td of the booklet T is opened, and thereafter, the push up cam 42 collectively pushes up the stitch Tb on the side of the front cover Ta to fold the booklet T.

Therefore, even the following booklets can be folded by collectively pushing up the pages, which provides a high level of convenience: a booklet having pages of a high flexural rigidity such as a booklet having an ID page attached with a security protection layer for preventing counterfeiting and falsification of private information, a booklet having a plastic page including an IC chip capable of high density recording, and a booklet having a wireless IC chip capable of reading and writing information without contact.

Further, compared with a mechanism for sandwiching and raising pages, the cam mechanism is small because the cam mechanism does not need a mechanism for sandwiching a booklet, and an arm for raising the sandwiched booklet, and the like. This is particularly effective in a case where the size of a booklet issuing apparatus is limited, and there in an advantage in that the control of the mechanisms can be simplified.

Further, the cam mechanism is used as the push up unit. Therefore, an advantage of the cam mechanism, i.e., fast and stable operation, can be made use of, and the booklet can be folded in a short time in a stable manner. As described above, the cam mechanism capable of stable operation is used, and therefore, the cam mechanism enables stable execution of the overall issuing processing of the booklet including operation for taking in a booklet, operation of turning pages, and print processing, which are preprocessing and postprocessing of the booklet folding operation. For a booklet issuing apparatus for issuing a booklet requiring a high degree of security needing to prevent counterfeiting and falsification in particular, this is advantageous because stability of booklet issuing processing is essential from the perspective of ensuring security.

The conveying speed of a booklet during folding operation is preferably slower than the conveying speed of the booklet to the page flip position 5. This is because, in order to reliably fold the booklet, it is necessary to accurately stop the booklet on the cam mechanism 42 arranged on the page flip position 5.

Further, a plurality of booklets is stacked and set in such a manner that the booklets are closed, and the booklets T are taken in one by one. Then, the booklets are folded, and pages are turned to open a print surface, onto which printing is performed. Therefore, an operator who uses this issuing apparatus does not need to open the print surface and set the booklet on the issuing apparatus on every occasion. Further, in a case where the apparatus issues a booklet requiring prevention of counterfeiting and falsification in particular, the apparatus can carry out operation from retrieval to issuing of a booklet without relying on an operator. Therefore, this is extremely effective from the perspective of ensuring security.

While certain embodiments have been described, those embodiments have been presented by way of example only, and are not intended to limit the scope of the inventions. Indeed, the novel methods and apparatuses described herein may be embodied in a variety of other forms; furthermore, various omissions, substitutions and changes in the form of the methods and apparatuses described herein may be made without departing from the spirit of the inventions. The accompanying claims and their equivalents are intended to cover such forms or modifications as would fall within the scope and spirit of the inventions.

What is claimed is:

1. A booklet handling apparatus comprising:

a take in unit to take in a booklet in a closed state;

a conveying unit to convey the booklet taken in by the take in unit to a predetermined position in a first direction;

a page turning unit to turn, about a stitch of the booklet, a back cover of the booklet conveyed to the predetermined position by the conveying unit;

a push up unit to push up a front cover of the booklet pivoting about the stitch thereof by rotating a push up cam arranged in contact with the front cover of the booklet, the push up cam being made of a metal or resin;

a support unit to support the front cover pushed up by the push up unit, the support unit including a first support unit to support, from one side, the front cover pushed up by the push up unit and a second support unit rotatable arranged to support, from the other side, the front cover while the booklet is being conveyed in the second direction; and a folding unit to fold the front cover by conveying the booklet in a second direction opposite to the first direction from the predetermined position using the conveying unit while the support unit supports the front cover, wherein a first speed at which the taken-in booklet is conveyed to the predetermined position in the first direction is faster than a second speed at which the booklet is conveyed from the predetermined position to a position in the second direction.

2. The apparatus according to claim 1 further comprising:

a print unit to convey the folded booklet in the first direction, open a predetermined page by turning pages about the stitch of the booklet using the page turning unit, and print data onto the predetermined page.

3. The apparatus according to claim 2 further comprising:

an accumulation unit to accumulate the booklet printed by the print unit.

4. The apparatus according to claim 1, wherein the take in unit takes in, one by one, a plurality of booklets stacked in a closed state.

5. The apparatus according to claim 1, wherein a surface of the support unit is made of a metal or a resin.

6. The apparatus according to claim 1, wherein a material of a surface of the second support unit is rubber.

7. A booklet handling method comprising:

taking in a booklet in a closed state;

conveying the taken-in booklet to a predetermined position in a first direction;

turning, about a stitch of the booklet, a back cover of the booklet conveyed to the predetermined position;

pushing up a front cover of the booklet pivoting about the stitch thereof by rotating a push up cam arranged in contact with the front cover of the booklet;

supporting the pushed up front cover; and folding the front cover by conveying the booklet in a second direction opposite to the first direction from the predetermined position while the front cover is supported, wherein a first speed at which the taken-in booklet is conveyed to the predetermined position in the first direction is faster than a second speed at which the booklet is conveyed from the predetermined position to a position in the second direction.

8. The method according to claim 7 further comprising:

conveying the folded booklet in the first direction;

opening a predetermined page by turning pages about the stitch of the booklet; and printing data onto the predetermined page.

9. The method according to claim 8 further comprising: accumulating the printed booklet.

10. The method according to claim 7, wherein in the taking in, a plurality of booklets stacked in a closed state is taken in one by one.

11. The method according to claim 7, wherein a first speed at which the taken-in booklet is conveyed to the predetermined position in the first direction is faster than a second speed at which the booklet is conveyed from the predetermined position to a position in the second direction.

* * * * *